US012768136B2

(12) United States Patent
Oasa et al.

(10) Patent No.: US 12,768,136 B2
(45) Date of Patent: Oct. 20, 2026

(54) CONTROL SYSTEM, LOADING MACHINE, AND CONTROL METHOD

(71) Applicant: KOMATSU LTD., Tokyo (JP)

(72) Inventors: Takahisa Oasa, Tokyo (JP); Shozo Kikuchi, Tokyo (JP); Ryota Kudo, Tokyo (JP); Yoshitaka Onodera, Tokyo (JP); Takehiro Komatsu, Tokyo (JP)

(73) Assignee: KOMATSU LTD., Tokyo (JP)

( * ) Notice: Subject to any disclaimer, the term of this patent is extended or adjusted under 35 U.S.C. 154(b) by 160 days.

(21) Appl. No.: 18/723,950

(22) PCT Filed: Feb. 24, 2023

(86) PCT No.: PCT/JP2023/006682

§ 371 (c)(1),
(2) Date: Dec. 12, 2024

(87) PCT Pub. No.: WO2023/163091

PCT Pub. Date: Aug. 31, 2023

(65) Prior Publication Data

US 2025/0327273 A1 Oct. 23, 2025

(30) Foreign Application Priority Data

Feb. 28, 2022 (JP) ..... 2022-030480

(51) Int. Cl.
*E02F 9/20* (2006.01)
*E02F 9/26* (2006.01)

(52) U.S. Cl.
CPC ..... *E02F 9/2029* (2013.01); *E02F 9/264* (2013.01)

(58) Field of Classification Search
CPC ..... E02F 9/2029; E02F 9/264; E02F 9/261; E02F 3/431
See application file for complete search history.

(56) References Cited

U.S. PATENT DOCUMENTS 3,893,302 A * 7/1975 Peterson ..... E02D 5/187 37/355
4,685,838 A * 8/1987 Curt ..... E02D 29/0266 405/284

(Continued)

FOREIGN PATENT DOCUMENTS

CN 104736772 A 6/2015
CN 118510968 A 8/2024

(Continued)

OTHER PUBLICATIONS

International Search Report for the corresponding international patent application No. PCT/JP2023/006682, issued on Apr. 4, 2023.
Hong, Won, "Modeling, Estimation, and Control of Robot-Soil Interactions", Massachusetts Institute of Technology, CSAIL Publications, AITR 2001-007, XP-00233886, Sep. 1, 2001, pp. 48-79.

(Continued)

*Primary Examiner* — Russell Frejd
(74) *Attorney, Agent, or Firm* — Spencer Fane LLP

(57) ABSTRACT

A control system for controlling a loading machine, which includes working equipment having a bucket, includes a controller. The controller calculates a traction force of the loading machine during excavation work of excavating an object to be excavated with the bucket. The controller calculates a load height representing a height of the object to be excavated inside the bucket during the excavation work. The controller calculates an earth pressure coefficient of the object to be excavated based on the traction force and the load height.

8 Claims, 15 Drawing Sheets

(56) References Cited

U.S. PATENT DOCUMENTS

| | | | | |
|---|---|---|---|---|
| 6,275,757 | B1 * | 8/2001 | Watanabe | E02F 9/2296 37/234 |
| 9,016,983 | B2 * | 4/2015 | Li | E21D 9/003 405/141 |
| 9,476,183 | B2 | 10/2016 | Nagato et al. | |
| 10,557,249 | B2 | 2/2020 | Tsuji | |
| 2011/0010059 | A1 * | 1/2011 | Suzuki | E02F 9/26 701/50 |
| 2014/0079485 | A1 * | 3/2014 | Li | E02D 3/12 702/9 |
| 2014/0330490 | A1 | 11/2014 | Aoki et al. | |
| 2015/0292185 | A1 | 10/2015 | Nagato et al. | |
| 2021/0189690 | A1 * | 6/2021 | Hyodo | E02F 9/2285 |
| 2025/0333930 | A1 | 10/2025 | Oasa et al. | |

FOREIGN PATENT DOCUMENTS

| | | | |
|---|---|---|---|
| EP | 3719223 | A1 | 10/2020 |
| JP | 2004239640 | A | 8/2004 |
| JP | 3976318 | B2 | 9/2007 |
| JP | 2012255320 | A | 12/2012 |
| JP | 5643717 | B2 | 12/2014 |
| JP | 2019-203381 | A | 11/2019 |

OTHER PUBLICATIONS

Extended European Search Report received for EP Application No. 23760090.3, mailed on Oct. 27, 2025, 7 pages.

The Chinese Office Action for the corresponding Chinese patent application No. 202380015821.X issued on Jun. 27, 2026.

* cited by examiner

CONTROL SYSTEM, LOADING MACHINE, AND CONTROL METHOD

CROSS-REFERENCE TO RELATED APPLICATIONS

This application is a U.S. National stage application of International Application No. PCT/JP2023/006682, filed on Feb. 24, 2023. This U.S. National stage application claims priority under 35 U.S.C. § 119(a) to Japanese Patent Application No. 2022-030480, filed in Japan on Feb. 28, 2022, the entire contents of which are hereby incorporated herein by reference.

The technology disclosed in the present specification relates to a control system, a loading machine, and a control method.

BACKGROUND

In the technical field related to a loading machine provided with working equipment, a loading machine capable of performing an efficient excavation operation as disclosed in JP 2019-203381 A is known.

SUMMARY

The loading machine excavates an object to be excavated with the working equipment, and then loads the excavated object onto a haul vehicle. It is desirable that the weight of the excavated object loaded onto the haul vehicle from the working equipment can be adjusted so that the excavated object with an optimum loading capacity is loaded onto the haul vehicle. In order to optimize the loading work by the loading machine, it is necessary to recognize the physical properties of the object to be excavated. One of physical property values of the object to be excavated is an earth pressure coefficient.

An object of the technology disclosed in the present specification is to calculate an earth pressure coefficient of an object to be excavated.

According to an aspect of the present disclosure, a control system is provided for controlling a loading machine including working equipment having a bucket. The control system includes a controller. The controller calculates traction force of the loading machine during excavation work of excavating an object to be excavated with the bucket, calculates a load height representing a height of the object to be excavated inside the bucket during the excavation work, and calculates an earth pressure coefficient of the object to be excavated based on the traction force and the load height.

According to the technology disclosed in the present specification, an earth pressure coefficient of an object to be excavated can be calculated.

DESCRIPTION OF EMBODIMENTS

Hereinafter, embodiments according to the present disclosure will be described with reference to the drawings, but the present disclosure is not limited to the embodiments. Components of the embodiments described below can be appropriately combined. Further, some components are not used in some cases.

In the embodiments, a local coordinate system is set in a loading machine 1, and a positional relationship between units will be described with reference to the local coordinate system. In the local coordinate system, a first axis extending in the left-right direction (vehicle width direction) of the loading machine 1 is defined as an X axis, a second axis extending in the front-rear direction of the loading machine 1 is defined as a Y axis, and a third axis extending in the up-down direction of the loading machine 1 is defined as a Z axis. The X axis and the Y axis are orthogonal to each other. The Y axis and the Z axis are orthogonal to each other. The Z axis and the X axis are orthogonal to each other. The +X direction corresponds to the right direction, and the −X direction corresponds to the left direction. The +Y direction corresponds to the front direction, and the −Y direction corresponds to the rear direction. The +Z direction corresponds to the upward direction, and the −Z direction corresponds to the downward direction.

[Loading Machine]

Figure 1:
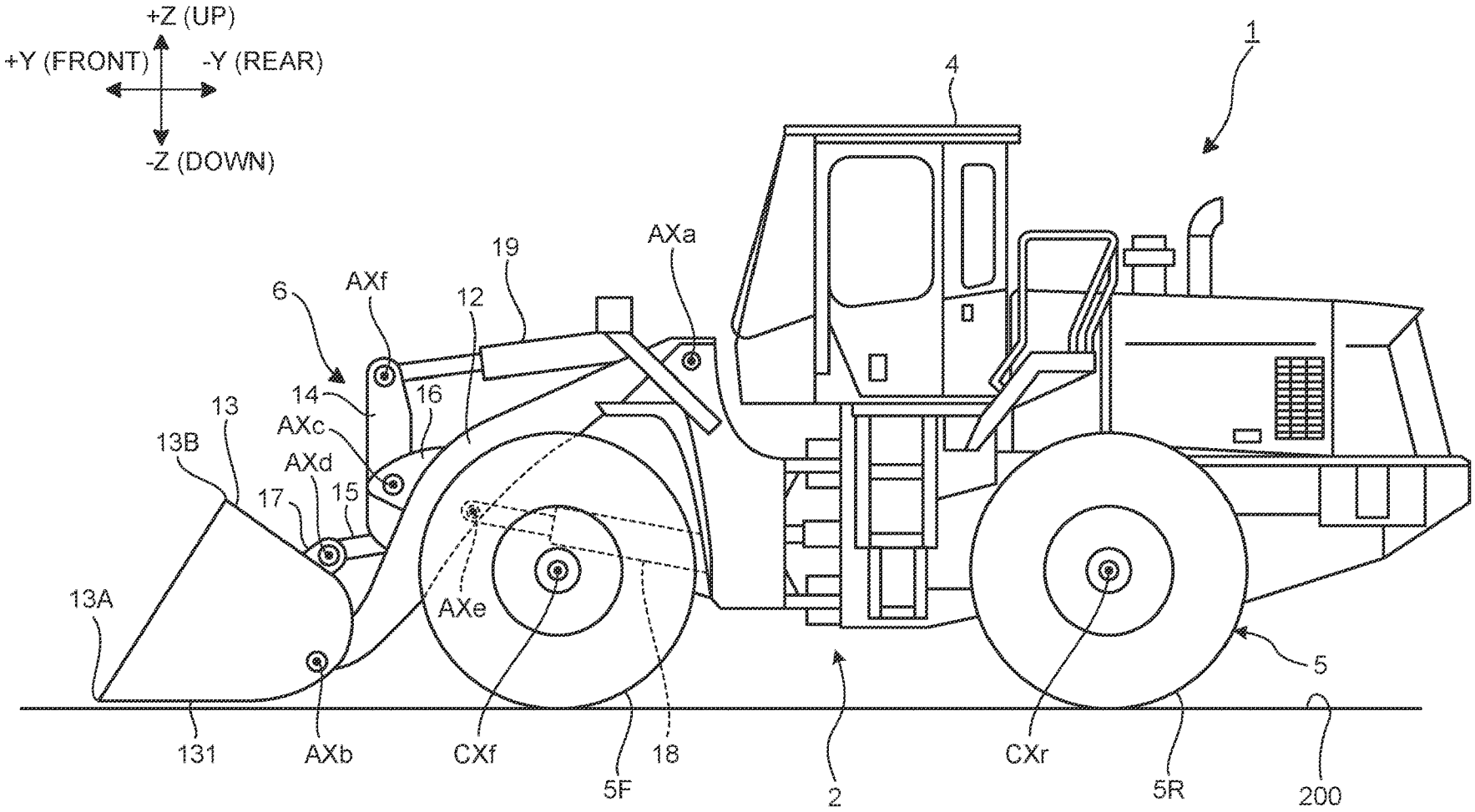
FIG. 1 is a side view illustrating a loading machine according to an embodiment.

FIG. 1 is a side view illustrating the loading machine 1 according to the embodiment. In the embodiment, the loading machine 1 is, for example, a wheel loader. In the following description, the loading machine 1 is appropriately referred to as a wheel loader 1.

As illustrated in FIG. 1, the wheel loader 1 includes a vehicle body 2, a cab 4, wheels 5, and working equipment 6.

The vehicle body 2 supports the working equipment 6. The cab 4 is supported by the vehicle body 2. In the embodiment, the cab 4 is disposed in an upper part of the vehicle body 2. The wheels 5 support the vehicle body 2. The wheels 5 include a front wheel 5F and a rear wheel 5R.

The front wheel 5F is rotatable about a rotation axis CXf. The rear wheel 5R is rotatable about a rotation axis CXr. When the wheel loader 1 travels straight, the rotation axis CXf of the front wheel 5F and the rotation axis CXr of the rear wheel 5R are parallel to each other. In the embodiment, the X axis is parallel to the rotation axis CXf of the front wheel 5F.

The working equipment 6 performs predetermined work. The working equipment 6 is supported by the vehicle body 2. The working equipment 6 is connected to the vehicle body 2. The working equipment 6 includes a boom 12, a bucket 13, a bell crank 14, a bucket link 15, a lift cylinder 18, and a bucket cylinder 19.

A proximal end portion of the boom 12 is pivotably connected to the vehicle body 2. The boom 12 pivots about a pivot AXa with respect to the vehicle body 2. A bracket 16 is fixed to a middle portion of the boom 12.

A proximal end portion of the bucket 13 is pivotably connected to a distal end portion of the boom 12. The bucket 13 pivots about a pivot AXb with respect to the boom 12. The bucket 13 is arranged ahead of the front wheel 5F. A bracket 17 is fixed to a part of the bucket 13.

A middle portion of the bell crank 14 is pivotably connected to the bracket 16. The bell crank 14 pivots about a pivot AXc with respect to the bracket 16. A lower end portion of the bell crank 14 is pivotably connected to a proximal end portion of the bucket link 15.

A distal end portion of the bucket link 15 is pivotably connected to the bracket 17. The bucket link 15 pivots about a pivot AXd with respect to the bracket 17. The bell crank 14 is connected to the bucket 13 via the bucket link 15.

The lift cylinder 18 operates the boom 12. A proximal end portion of the lift cylinder 18 is connected to the vehicle body 2. A distal end portion of the lift cylinder 18 is connected to the boom 12. The boom 12 pivots about a pivot AXe with respect to the lift cylinder 18.

The bucket cylinder 19 operates the bucket 13. A proximal end portion of the bucket cylinder 19 is connected to the vehicle body 2. A distal end portion of the bucket cylinder 19 is connected to an upper end portion of the bell crank 14. The bell crank 14 pivots about a pivot AXf with respect to the bucket cylinder 19.

Figure 2:
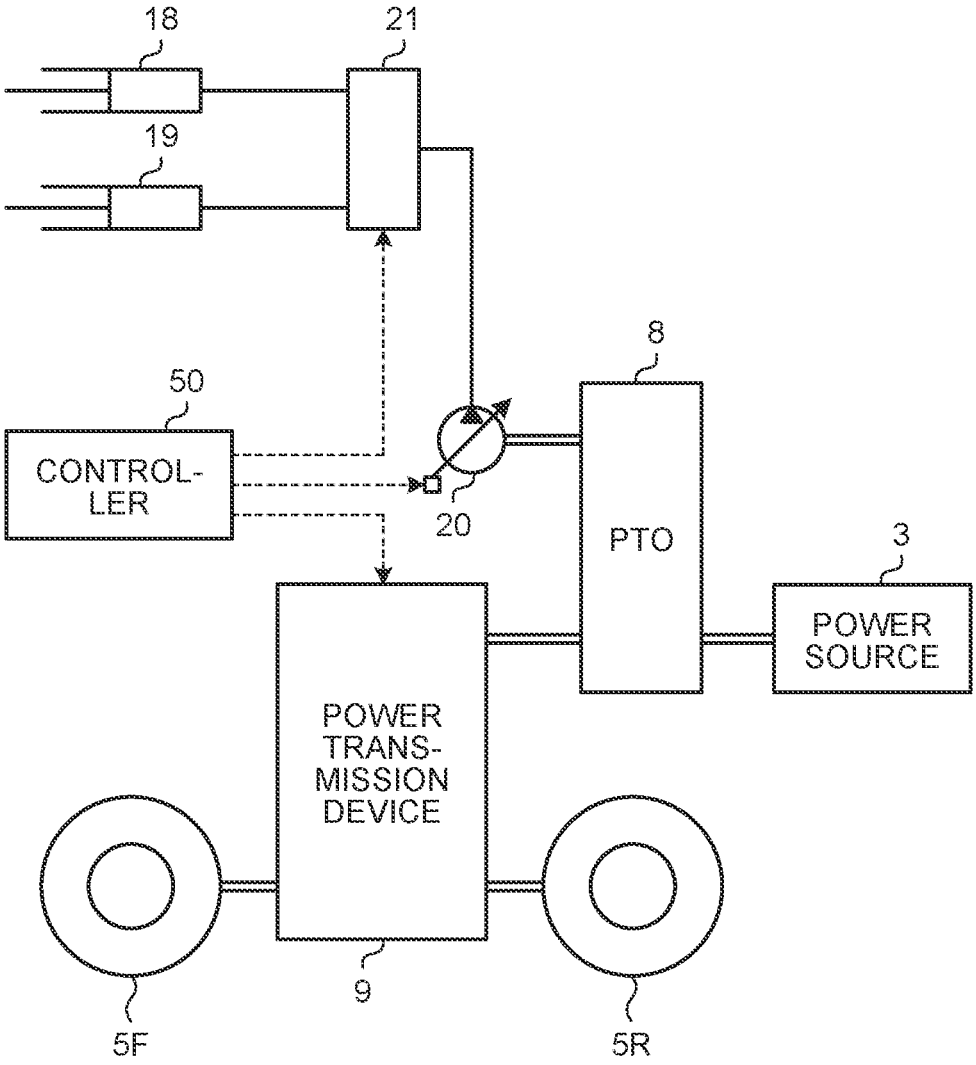
FIG. 2 is a configuration diagram illustrating the loading machine according to the embodiment.

FIG. 2 is a configuration diagram illustrating the loading machine 1 according to the embodiment. The loading machine 1 includes a power source 3, a power take off (PTO) 8, a power transmission device 9, a hydraulic pump 20, a control valve 21, and a controller 50.

The power source 3 produces driving force for operating the wheel loader 1. The power source 3 is, for example, a diesel engine.

The power take off 8 distributes the driving force from the power source 3 to the power transmission device 9 and the hydraulic pump 20. The driving force of the power source 3 is transmitted to each of the power transmission device 9 and the hydraulic pump 20 via the power take off 8.

The power transmission device 9 includes an input shaft to which the driving force is input from the power source 3 and an output shaft that converts the driving force, which is input to the input shaft, and outputs the resultant. The input shaft of the power transmission device 9 is connected to the power take off 8. The output shaft of the power transmission device 9 is connected to each of the front wheel 5F and the rear wheel 5R. The driving force of the power source 3 is transmitted to each of the front wheel 5F and the rear wheel 5R via the power transmission device 9. The power transmission device 9 may include an axle device or a differential device.

The hydraulic pump 20 discharges hydraulic oil. The hydraulic pump 20 is a variable displacement hydraulic pump. The hydraulic pump 20 is driven based on the driving force of the power source 3. The hydraulic oil discharged from the hydraulic pump 20 is supplied to the lift cylinder 18 and the bucket cylinder 19 via the control valve 21.

The control valve 21 controls the flow rate and direction of the hydraulic oil supplied to each of the lift cylinder 18 and the bucket cylinder 19. The working equipment 6 is operated with the hydraulic oil supplied from the hydraulic pump 20 via the control valve 21.

The controller 50 controls the wheel loader 1. The controller 50 includes a computer system.

[Bucket]

Figure 3:
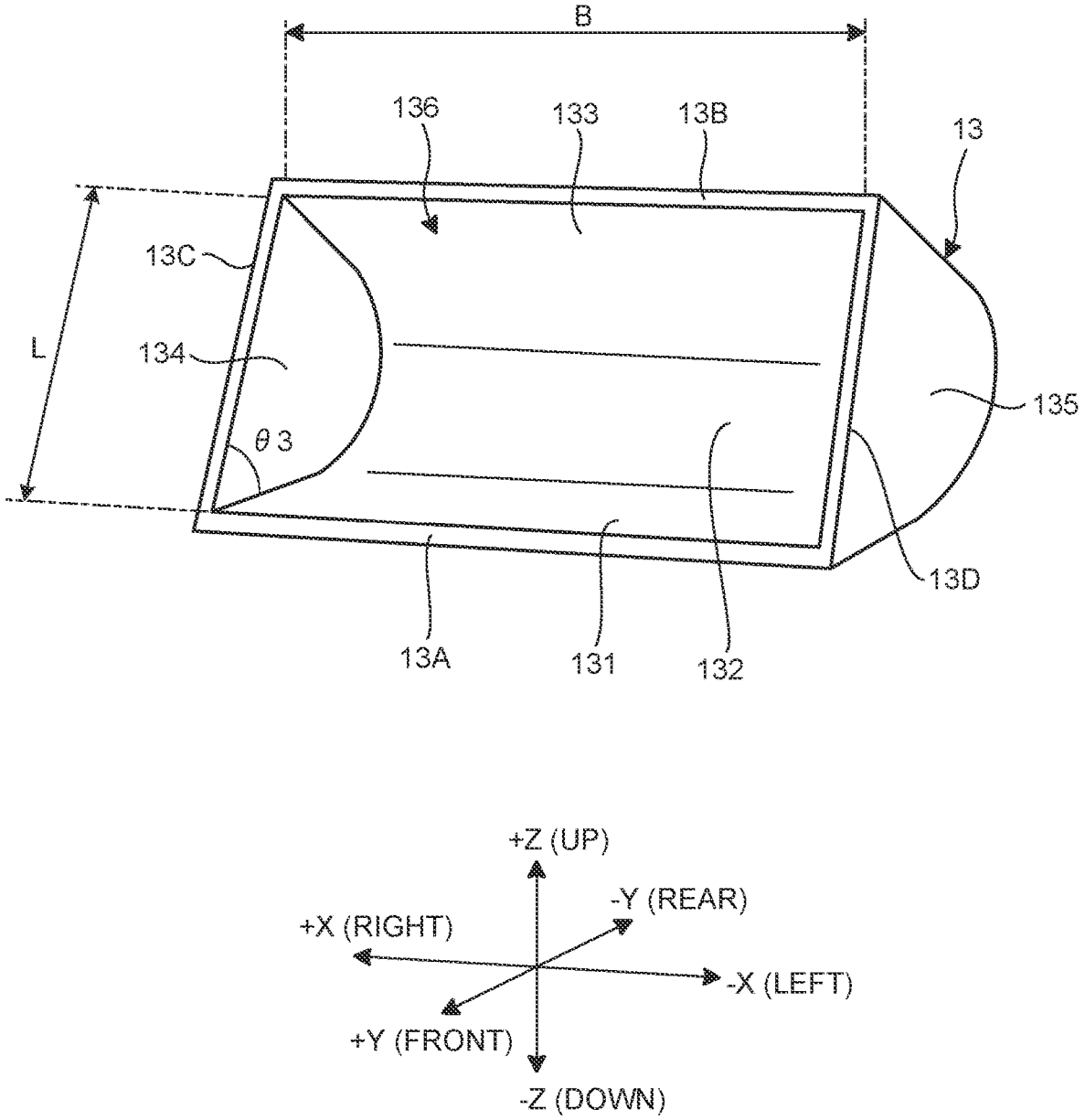
FIG. 3 is a perspective view illustrating a bucket according to the embodiment.
Figure 4:
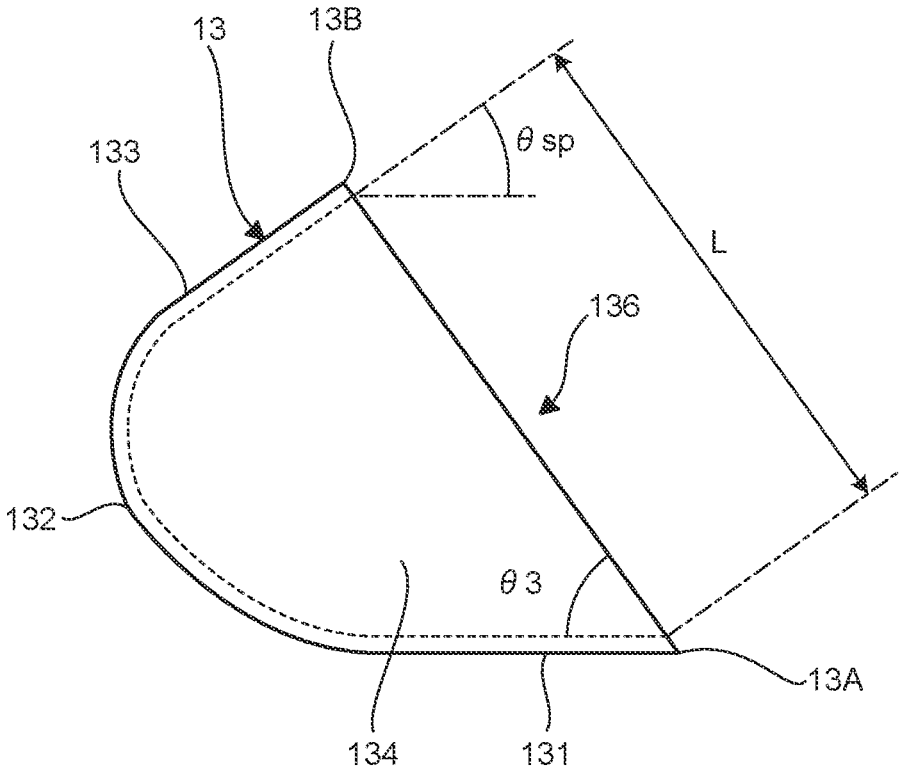
FIG. 4 is a side view schematically illustrating the bucket according to the embodiment.
Figure 4:
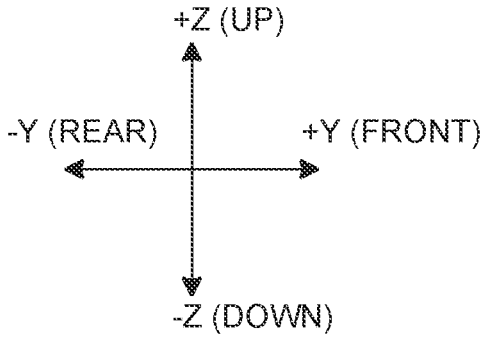

FIG. 3 is a perspective view illustrating the bucket 13 according to the embodiment. FIG. 4 is a side view schematically illustrating the bucket 13 according to the embodiment. The bucket 13 is a working member that excavates an object to be excavated. The bucket 13 holds an excavated object 300. The excavated object 300 is an object that is excavated and held by the bucket 13.

The bucket 13 includes a bottom plate portion 131, a back plate portion 132, a top plate portion 133, a right plate portion 134, and a left plate portion 135. A tip portion of the bottom plate portion 131 is a blade edge portion 13A. A blade edge or a blade is attached to the blade edge portion 13A. A tip portion of the top plate portion 133 is a spill guard end portion 13B. A tip portion of the right plate portion 134 is a right end portion 13C. A tip portion of the left plate portion 135 is a left end portion 13D. The blade edge portion 13A extends in the left-right direction. The spill guard end portion 13B extends in the left-right direction. The right end portion 13C extends in the up-down direction or the front-rear direction. The left end portion 13D extends in the up-down direction or the front-rear direction. The blade edge portion 13A and the spill guard end portion 13B face each other. The right end portion 13C and the left end portion 13D face each other. The blade edge portion 13A and the spill guard end portion 13B are parallel to each other. The right end portion 13C and the left end portion 13D are parallel to each other.

An opening portion 136 of the bucket 13 is defined between the blade edge portion 13A, the spill guard end portion 13B, the right end portion 13C, and the left end portion 13D. The opening portion 136 is defined by the blade edge portion 13A, the spill guard end portion 13B, the right end portion 13C, and the left end portion 13D.

In the embodiment, a dimension of the opening portion 136 in the up-down direction or the front-rear direction, that is, a dimension of a straight line connecting the blade edge portion 13A and the spill guard end portion 13B on the YZ plane is defined as a bucket length L. The dimension of the opening portion 136 in the left-right direction is defined as a bucket width B. A cross-sectional area of the bucket 13 parallel to the YZ plane is defined as a bucket cross-sectional area Abk. An angle formed by the inner surface of the bottom plate portion 131 and a straight line connecting the blade edge portion 13A and the spill guard end portion 13B on the YZ plane is defined as a blade edge side opening angle θ3. An angle formed by a plane parallel to the inner surface of the bottom plate portion 131 and the inner surface of the top plate portion 133 on the YZ plane is defined as an upper opening angle θsp.

[Operation of Working Equipment]

Figure 5:
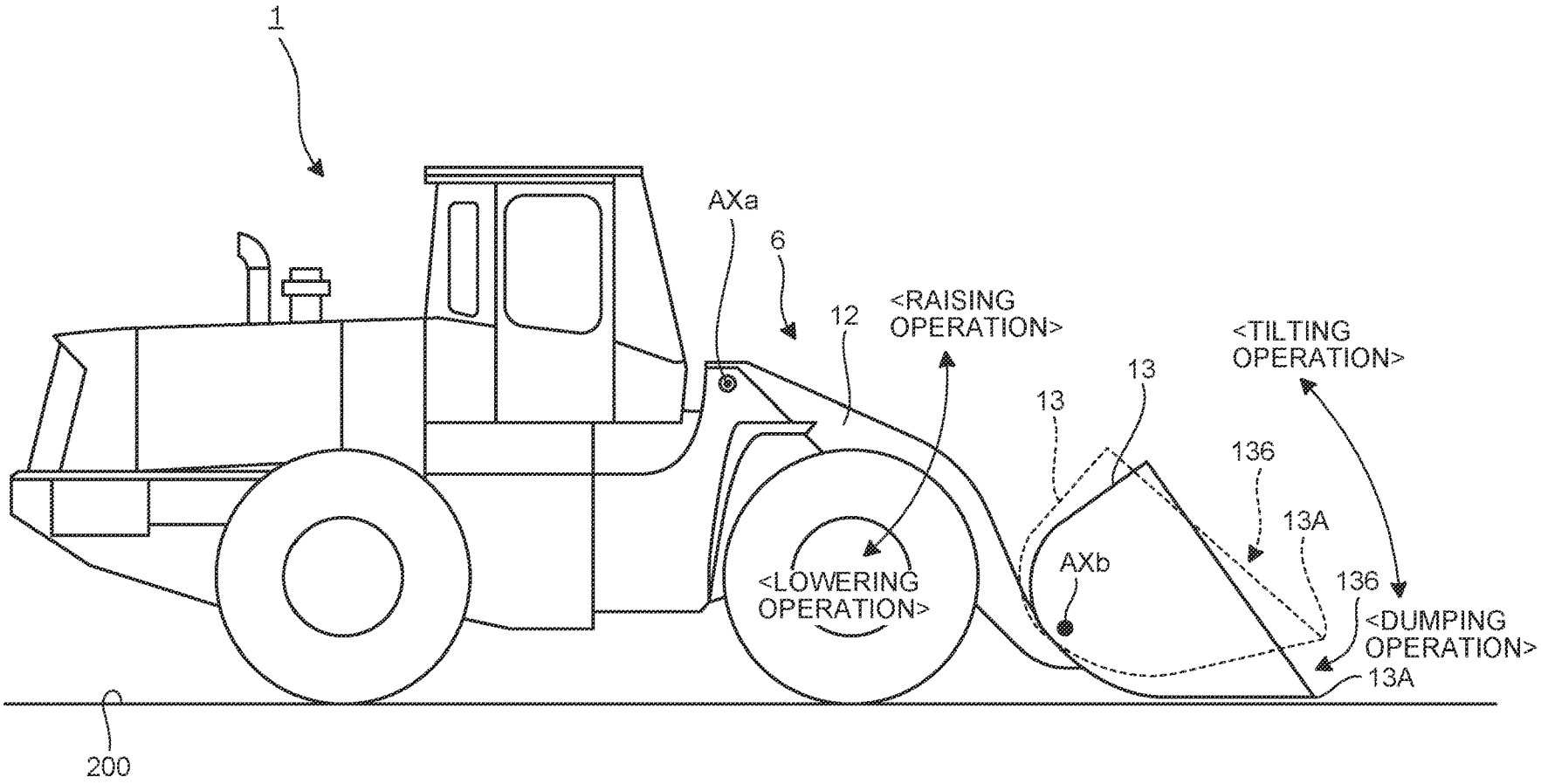
FIG. 5 is a diagram for explanation of an operation of working equipment according to the embodiment.

FIG. 5 is a diagram for explanation of an operation of the working equipment 6 according to the embodiment. In the embodiment, the working equipment 6 is front-loading working equipment in which the opening portion 136 of the bucket 13 faces forward during excavation work.

The operation of raising the boom 12 refers to the operation of pivoting the boom 12 about the pivot AXa so that the distal end portion of the boom 12 is separated from the ground 200. The lift cylinder 18 extends, and the boom 12 is thereby raised.

The operation of lowering the boom 12 refers to the operation of pivoting the boom 12 about the pivot AXa so that the distal end portion of the boom 12 approaches the ground 200. The lift cylinder 18 contracts, and the boom 12 is thereby lowered.

The tilting operation of the bucket 13 refers to the operation of pivoting the bucket 13 about the pivot AXb so that the blade edge portion 13A of the bucket 13 is separated from the ground 200. When the bucket cylinder 19 extends, the bell crank 14 pivots such that the upper end portion of the bell crank 14 moves forward and the lower end portion of the bell crank 14 moves backward. When the lower end portion of the bell crank 14 moves backward, the bucket 13 is pulled backward by the bucket link 15 and performs the tilting operation. When the bucket 13 performs the tilting operation, an object to be excavated is scooped by the bucket 13, and the excavated object 300 is held by the bucket 13.

The dumping operation of the bucket 13 refers to the operation of pivoting the bucket 13 about the pivot AXb so that the blade edge portion 13A of the bucket 13 approaches the ground 200. When the bucket cylinder 19 contracts, the bell crank 14 pivots such that the upper end portion of the bell crank 14 moves backward and the lower end portion of the bell crank 14 moves forward. When the lower end of the bell crank 14 moves forward, the bucket 13 is pushed forward by the bucket link 15 and performs the dumping operation. When the bucket 13 performs the dumping operation, the excavated object 300 held by the bucket 13 is discharged from the bucket 13.

[Operation of Loading Machine]

Figure 6:
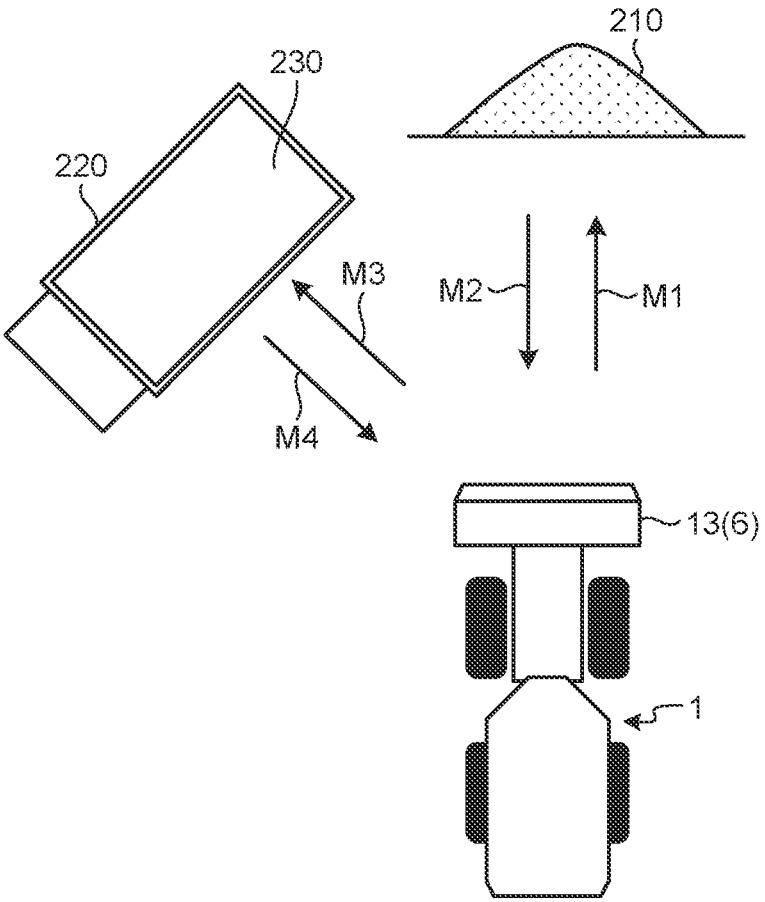
FIG. 6 is a diagram for explanation of the loading machine according to the embodiment.

FIG. 6 is a diagram for explanation of the wheel loader 1 according to the embodiment. The wheel loader 1 performs predetermined work on a work target at a work site. The work target includes an object to be excavated and a loading target. The predetermined work includes excavation work and loading work.

The object to be excavated is, for example, natural ground, a rock pile, coal, feed, or a wall surface. The natural ground is a pile of earth and sand placed on the ground 200. The rock pile is a pile of rock or stone placed on the ground 200. In the embodiment, the object to be excavated is natural ground 210. The excavated object 300 is the natural ground 210 that is excavated and held by the bucket 13.

The loading target is, for example, a haul vehicle, a predetermined area of a work site, a hopper, a belt conveyor, or a crusher. In the embodiment, the loading target is a dump body 230 of the haul vehicle 220 capable of traveling on the ground 200. The haul vehicle 220 is, for example, a dump truck.

The wheel loader 1 performs excavation work of excavating the natural ground 210 with the bucket 13. The wheel loader 1 excavates the natural ground 210 with the bucket 13 while advancing toward the natural ground 210. The wheel loader 1 performs loading work of loading the excavated object 300 held by the bucket 13 in the excavation work onto the dump body 230. The loading work is a concept including discharging work of discharging the excavated object 300.

In the excavation work, as indicated by an arrow M1 in FIG. 6, the wheel loader 1 advances toward the natural ground 210 in a state where the excavated object 300 is not held by the bucket 13. The wheel loader 1 performs the excavation work by tilting the bucket 13 inserted into the natural ground 210. When the bucket 13 performs the tilting operation, the natural ground 210 is excavated by the bucket 13, and the excavated object 300 is held by the bucket 13.

Next, as indicated by an arrow M2 in FIG. 6, the wheel loader 1 moves backward so as to be separated from the natural ground 210 in a state where the excavated object 300 is held by the bucket 13.

Next, loading work is performed. In the loading work, as indicated by an arrow M3 in FIG. 6, the wheel loader 1 advances while swinging toward the haul vehicle 220 in a state where the excavated object 300 is held by the bucket 13. In a state where the wheel loader 1 advances toward the haul vehicle 220, the wheel loader 1 performs the operation of raising the boom 12 such that the bucket 13 is disposed above the dump body 230. After the boom 12 is raised and the bucket 13 is disposed above the dump body 230, the wheel loader 1 performs the loading work by causing the bucket 13 to perform the dumping operation. When the bucket 13 performs the dumping operation, the excavated object 300 held by the bucket 13 is discharged from the bucket 13 and loaded onto the dump body 230.

After the excavated object 300 is loaded onto the dump body 230, as indicated by an arrow M4 in FIG. 6, the wheel loader 1 moves backward while swinging so as to be separated from the haul vehicle 220 in a state where the excavated object 300 is not held by the bucket 13.

The wheel loader 1 repeats the operation described above until the dump body 230 of the haul vehicle 220 is filled with the excavated object 300 or until the natural ground 210 is completely excavated.

[Control System]

Figure 7:
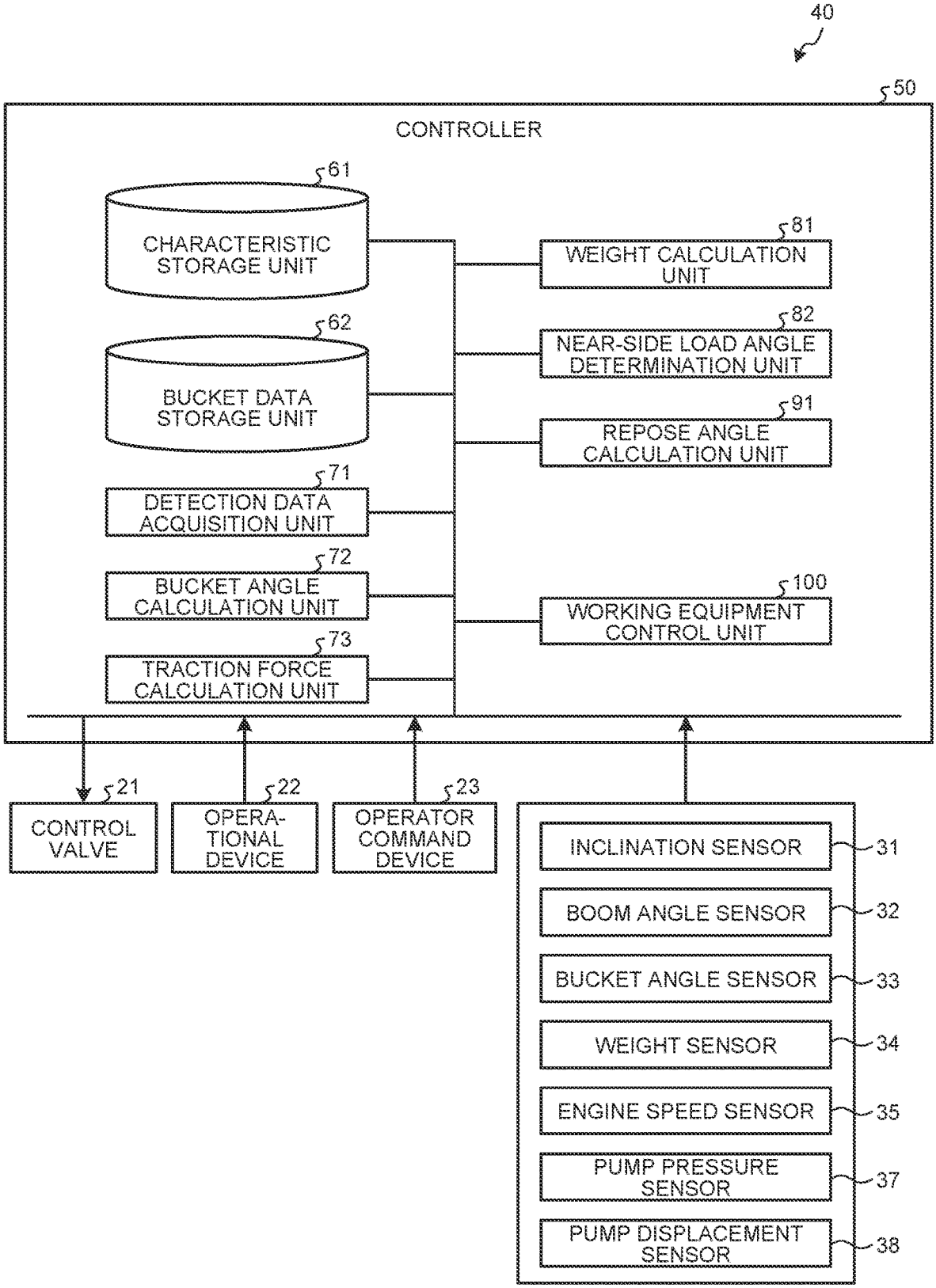
FIG. 7 is a functional block diagram illustrating a control system of the loading machine according to the embodiment.
Figure 8:
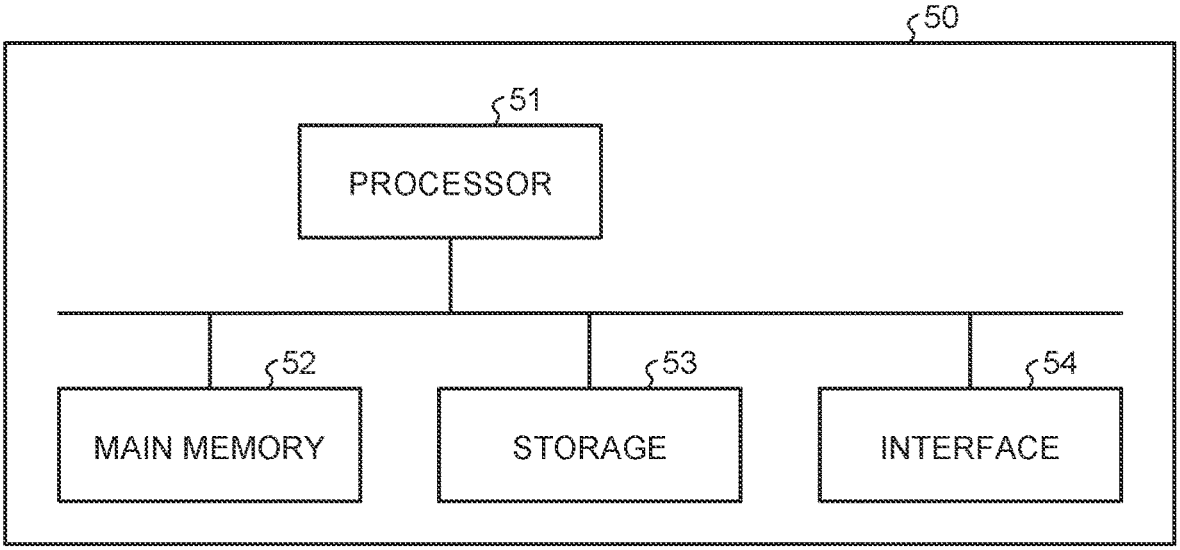
FIG. 8 is a block diagram illustrating a control device of the loading machine according to the embodiment.

FIG. 7 is a functional block diagram illustrating a control system 40 of the wheel loader 1 according to the embodiment. FIG. 8 is a block diagram illustrating the controller 50 of the wheel loader 1 according to the embodiment.

The wheel loader 1 includes the control system 40. The control system 40 includes a control valve 21, an operational device 22, an operator command device 23, an inclination sensor 31, a boom angle sensor 32, a bucket angle sensor 33, a weight sensor 34, an engine speed sensor 35, a pump pressure sensor 37, a pump displacement sensor 38, and a controller 50.

The operational device 22 is disposed inside the cab 4. The operational device 22 is operated by an operator. The operational device 22 generates an operation signal for operating each of the power source 3, the power transmission device 9, and the working equipment 6. The controller 50 controls the power source 3 and the power transmission device 9 based on the operation signal generated by the operational device 22. The controller 50 controls the control valve 21 based on the operation signal generated by the operational device 22.

The operator command device 23 is disposed inside the cab 4. The operator command device 23 includes, for example, a switch button. The operator command device 23 is operated by the operator. The operator command device 23 generates a command signal for calculating an angle of repose θr to be described later or for calculating an earth pressure coefficient K. The controller 50 calculates the angle of repose θr or calculates the earth pressure coefficient K based on the operation signal generated by the operator command device 23.

The inclination sensor 31 detects the inclination of the vehicle body 2. More specifically, the inclination sensor 31 detects a vehicle body inclination angle θa representing the angle of inclination of the vehicle body 2 with respect to the horizontal plane. The inclination sensor 31 is disposed in at least a part of the vehicle body 2. The inclination sensor 31 is, for example, an inertial measurement unit (IMU). Detection data on the vehicle body inclination angle θa detected by the inclination sensor 31 is transmitted to the controller 50.

The boom angle sensor 32 detects an angle of the boom 12. More specifically, the boom angle sensor 32 detects a boom angle θb representing the angle of the boom 12 with respect to the vehicle body 2 in the local coordinate system. The boom angle sensor 32 is, for example, an angle sensor disposed at a connection portion between the vehicle body 2 and the boom 12. In the embodiment, the boom angle θ*b* is an angle formed by a line connecting the pivot AXa and the pivot AXb and a line connecting the rotation axis CXf and the rotation axis CXr. Detection data on the boom angle θb detected by the boom angle sensor 32 is transmitted to the controller 50. The boom angle sensor 32 may be a stroke sensor that detects a stroke of the lift cylinder 18.

The bucket angle sensor 33 detects an angle of the bucket 13. More specifically, the bucket angle sensor 33 detects a bell crank angle θc representing the angle of the bell crank 14 with respect to the boom 12 in the local coordinate system. The bucket angle sensor 33 is, for example, an angle sensor disposed at a connection portion between the boom 12 and the bell crank 14. In the embodiment, the bell crank angle θc is an angle formed by a line connecting the pivot AXc and the pivot AXf and a line connecting the pivot AXa and the pivot AXb. The angle of the bucket 13 with respect to the boom 12 in the local coordinate system corresponds to the bell crank angle θc on a one-to-one basis. The angle of the bucket 13 with respect to the boom 12 in the local coordinate system is detected by detecting the bell crank angle θ*c*. Detection data on the bell crank angle θc detected by the bucket angle sensor 33 is transmitted to the controller 50. The bucket angle sensor 33 may be a stroke sensor that detects a stroke of the bucket cylinder 19.

The weight sensor 34 detects a weight Wa of the excavated object 300, which is an object to be excavated, held by the bucket 13. The weight sensor 34 is, for example, a pressure sensor that detects the pressure of the hydraulic oil in the lift cylinder 18 or a pressure sensor that detects the pressure of the hydraulic oil in the bucket cylinder 19. A load applied to the working equipment 6 changes between a state where the excavated object 300 is held by the bucket 13 and a state where the excavated object 300 is not held by the bucket 13. The weight sensor 34 detects a change in load applied to the working equipment 6 to thereby detect the weight Wa of the excavated object 300 held by the bucket 13. Detection data on the weight Wa of the excavated object 300 detected by the weight sensor 34 is transmitted to the controller 50. The weight sensor 34 may be a load meter disposed in at least a part of the working equipment 6. The weight sensor 34 may directly detect the weight Wa of the excavated object 300.

The engine speed sensor 35 detects the engine speed of the power source 3.

The pump pressure sensor 37 detects a discharge pressure representing the pressure of the hydraulic oil discharged from the hydraulic pump 20.

The pump displacement sensor 38 detects the displacement of the hydraulic pump 20 based on an angle of a swash plate of the hydraulic pump 20.

The controller 50 includes a computer system. The controller 50 outputs a control command for controlling the wheel loader 1.

As illustrated in FIG. 8, the controller 50 includes a processor 51, a main memory 52, a storage 53, and an interface 54. The processor 51 executes a computer program to calculate the operation of the working equipment 6. Examples of the processor 51 include a central processing unit (CPU) and a micro processing unit (MPU). The main memory 52 is, for example, a nonvolatile memory or a volatile memory. The nonvolatile memory is, for example, a read only memory (ROM). The volatile memory is, for example, a random access memory (RAM). The storage 53 is a non-transitory tangible storage medium. The storage 53 is, for example, a magnetic disk, a magneto-optical disk, or a semiconductor memory. The storage 53 may be an internal medium directly connected to a bus of the controller 50 or an external medium connected to the controller 50 via the interface 54 or a communication line. The storage 53 stores a computer program for controlling the working equipment 6.

As illustrated in FIG. 7, the controller 50 includes a characteristic storage unit 61, a bucket data storage unit 62, a detection data acquisition unit 71, a bucket angle calculation unit 72, a traction force calculation unit 73, a weight calculation unit 81, a near-side load angle determination unit 82, a repose angle calculation unit 91, an earth pressure coefficient calculation unit 92, and a working equipment control unit 100. The controller 50 communicates with each of the control valve 21, the operational device 22, the operator command device 23, the inclination sensor 31, the boom angle sensor 32, the bucket angle sensor 33, the weight sensor 34, the engine speed sensor 35, the pump pressure sensor 37, and the pump displacement sensor 38.

<Characteristic Storage Unit>

The characteristic storage unit 61 stores characteristic data on an object to be excavated. The characteristic data on an object to be excavated includes a natural ground angle θ*g* representing an angle formed by the ground 200 and the surface of the natural ground 210, an angle of repose θr of earth and sand constituting the natural ground 210, a density p of the natural ground 210, and an earth pressure coefficient K of the natural ground 210. The characteristic storage unit 61 also stores correlation data indicating a relationship between the natural ground angle θg and the angle of repose θr.

<Bucket Data Storage Unit>

The bucket data storage unit 62 stores bucket data indicating the shape or dimensions of the bucket 13. The bucket data includes the bucket length L, the bucket width B, the blade edge side opening angle θ3, the upper opening angle θsp, and the bucket cross-sectional area Abk. The bucket data is known data derived from specification data or design data.

<Detection Data Acquisition Unit>

The detection data acquisition unit 71 acquires detection data from each of the inclination sensor 31, the boom angle sensor 32, the bucket angle sensor 33, the weight sensor 34, the engine speed sensor 35, the pump pressure sensor 37, and the pump displacement sensor 38. The detection data acquisition unit 71 acquires the vehicle body inclination angle θa from the inclination sensor 31. The detection data acquisition unit 71 acquires the boom angle θb from the boom angle sensor 32. The detection data acquisition unit 71 acquires the bell crank angle θc from the bucket angle sensor 33. The detection data acquisition unit 71 acquires the weight Wa of the excavated object 300 from the weight sensor 34. The detection data acquisition unit 71 acquires the engine speed of the power source 3 from the engine speed sensor 35. The detection data acquisition unit 71 acquires the discharge pressure of the hydraulic pump 20 from the pump pressure sensor 37. The detection data acquisition unit 71 acquires the displacement of the hydraulic pump 20 from the pump displacement sensor 38.

<Bucket Angle Calculation Unit>

The bucket angle calculation unit 72 calculates a bucket angle θbk representing the angle of the bucket 13 with respect to the horizontal plane.

The bucket angle calculation unit 72 calculates the bucket angle θbk based on the detection data on an angle of the vehicle body 2 and the detection data on an angle of the working equipment 6. The detection data on an angle of the working equipment 6 includes detection data on the boom angle θb representing the angle of the boom 12 in the local coordinate system detected by the boom angle sensor 32 and detection data on the bell crank angle θc representing the angle of the bell crank 14 in the local coordinate system detected by the bucket angle sensor 33. The bucket angle calculation unit 72 can calculate the bucket angle θbk based on the detection data on the vehicle body inclination angle θa, the detection data on the boom angle θb, and the detection data on the bell crank angle θc.

<Traction Force Calculation Unit>

The traction force calculation unit 73 calculates traction force F of the wheel loader 1 based on the detection data acquired by the detection data acquisition unit 71. The traction force calculation unit 73 calculates the traction force F during the excavation work of excavating the natural ground 210 with the bucket 13.

For example, in a case where the power transmission device 9 has a continuously variable transmission, the traction force calculation unit 73 calculates the traction force F in the following procedure. The traction force calculation unit 73 uses detection data of the engine speed sensor 35 to calculate output torque of the power source. In addition, the traction force calculation unit 73 calculates load torque of the hydraulic pump 20 based on detection data of the pump pressure sensor 37 and detection data of the pump displacement sensor 38. The traction force calculation unit 73 calculates the traction force F by multiplying traveling torque that is obtained by subtracting the load torque from the output torque by the axle ratio and the torque efficiency of the power transmission device 9 and dividing the resultant by the effective diameter of the wheel.

For example, in a case where the power transmission device 9 includes a torque converter, the traction force calculation unit 73 calculates the traction force F in the following procedure. The traction force calculation unit 73 calculates the traveling torque by multiplying a value that is obtained by squaring the engine speed of the power source 3 divided by 1000 rpm by the primary torque coefficient and the torque ratio of the torque converter. The primary torque coefficient and the torque ratio are characteristic values determined based on the input/output rotation ratio of the torque converter. The traction force calculation unit 73 calculates the traction force F by multiplying the traveling torque by the axle ratio and the torque efficiency of the power transmission device 9 and dividing the resultant by the effective diameter of the wheel 5.

<Weight Calculation Unit>

The weight calculation unit 81 calculates the weight Wa of the excavated object 300, which is an object to be excavated, held by the bucket 13. In a case where the inside of the bucket 13 is filled with the excavated object 300, the weight calculation unit 81 calculates the weight Wa based on a first calculation method. In a case where a part of the inside of the bucket 13 is filled with the excavated object 300 and a void 340 is formed in a part of the inside of the bucket 13, the weight calculation unit 81 calculates the weight Wa based on a second calculation method.

Figure 9:
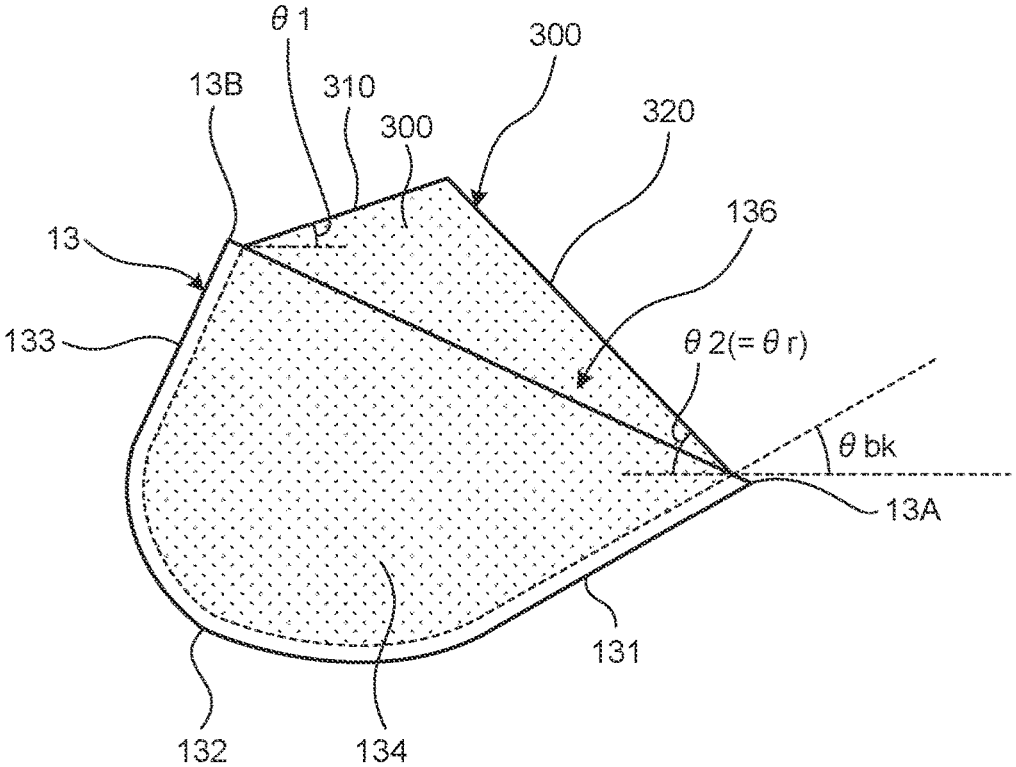
FIG. 9 is a diagram for explanation of a state of an excavated object held by the bucket according to the embodiment.

FIG. 9 is a diagram for explanation of a state of the excavated object 300 held by the bucket 13 according to the embodiment. FIG. 9 illustrates a state where the inside of the bucket 13 is filled with the excavated object 300, and a part of the excavated object 300 is placed outside beyond the opening portion 136 of the bucket 13. In the following description, the excavated object 300 placed outside beyond the opening portion 136 of the bucket 13 is appropriately referred to as an exposed part 330 of the excavated object 300.

The surface of the excavated object 300 excavated by the bucket 13 includes a first surface 310 and a second surface 320. The second surface 320 is present ahead of the first surface 310. The first surface 310 slopes upwardly toward the front. The second surface 320 slopes downwardly toward the front. The rear end of the first surface 310 is connected to the spill guard end portion 13B. The front end of the second surface 320 is connected to the blade edge portion 13A. The rear end of the second surface 320 is connected to the front end of the first surface 310. In a cross section orthogonal to the pivot AXb, a triangle is substantially formed by the first surface 310, the second surface 320, and the right end portion 13C (left end portion 13D).

In the embodiment, the angle of the first surface 310 with respect to the horizontal plane is appropriately referred to as a near-side load angle θ1, and the angle of the second surface 320 with respect to the horizontal plane is appropriately referred to as a blade edge side load angle θ2.

The near-side load angle θ1 changes based on the bucket angle θbk at the time of excavation. When the bucket angle θbk increases, the near-side load angle θ1 increases. When the bucket angle θbk decreases, the near-side load angle θ1 decreases.

The blade edge side load angle θ2 represents the angle of repose θr (stop repose angle) of the excavated object 300. Even if the bucket angle θbk at the time of excavation changes, the blade edge side load angle θ2 does not substantially change because the blade edge side load angle θ2 is formed when the bucket 13 is removed after the excavation. The blade edge side load angle θ2 is uniquely determined based on the property of the excavated object 300 (natural ground 210). In a case where the property of the excavated object 300 is constant, the blade edge side load angle θ2 does not substantially change even if the bucket angle θbk at the time of excavation changes.

In a case where the state of the excavated object 300 is the state illustrated in FIG. 9, the weight calculation unit 81 calculates the weight Wa of the excavated object 300 based on the first calculation method. The weight calculation unit 81 calculates the weight Wa of the excavated object 300 held by the bucket 13 based on the near-side load angle θ1, the blade edge side load angle θ2, the bucket angle θbk, the density ρ of the excavated object 300, and the bucket data.

Figure 10:
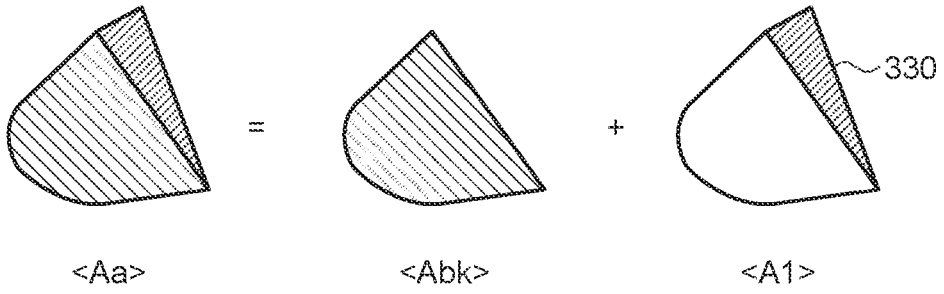
FIG. 10 is a schematic diagram for explanation of a method of calculating the weight of an excavated object based on a first calculation method according to the embodiment.

FIG. 10 is a schematic diagram for explanation of a method of calculating the weight Wa of the excavated object 300 based on the first calculation method according to the embodiment.

As illustrated in FIG. 10, an exposed part cross-sectional area A1 representing a cross-sectional area of the exposed part 330 orthogonal to the pivot AXb is calculated based on the following formula (1).

$$A1 = \frac{L^2 \times \sin(\theta 1 + \theta 3 - \theta bk) \times \sin(\theta 2 - \theta 3 + \theta bk)}{2 \times \sin(\theta 1 + \theta 2)} \quad (1)$$

The bucket cross-sectional area Abk representing the cross-sectional area of the bucket 13 orthogonal to the pivot AXb is stored in the bucket data storage unit 62. A load cross-sectional area Aa representing the cross-sectional area of the excavated object 300 orthogonal to the pivot AXb is calculated based on the following formula (2).

$$Aa = Abk + A1 \quad (2)$$

The volume Va of the excavated object 300 is calculated based on the following formula (3).

$$Va = Aa \times B \quad (3)$$

The density ρ of the excavated object 300 is stored in the characteristic storage unit 61. The weight Wa of the excavated object 300 in the state illustrated in FIG. 9 is calculated based on the following formula (4).

$$Wa = Va \times \rho \quad (4)$$

Figure 11:
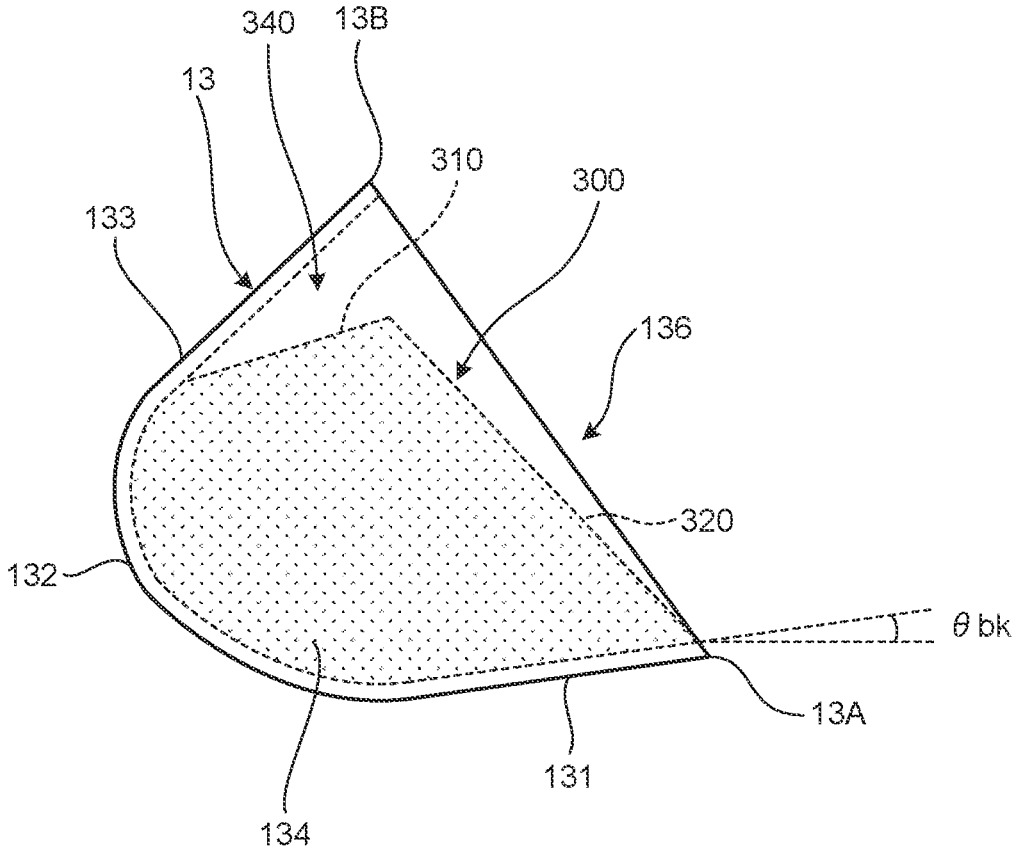
FIG. 11 is a diagram for explanation of a state of an excavated object held by the bucket according to the embodiment.

FIG. 11 is a diagram for explanation of a state of the excavated object 300 held by the bucket 13 according to the embodiment. FIG. 11 illustrates a state where a part of the inside of the bucket 13 is filled with the excavated object 300 and the void 340 is formed in a part of the inside of the bucket 13.

In a case where the state of the excavated object 300 is the state illustrated in FIG. 11, the weight calculation unit 81 calculates the weight Wa of the excavated object 300 based on the second calculation method. The weight calculation unit 81 calculates the weight Wa of the excavated object 300 held by the bucket 13 based on the traction force F, the bucket angle θbk, the density ρ of the excavated object 300, and the bucket data.

Figure 12:
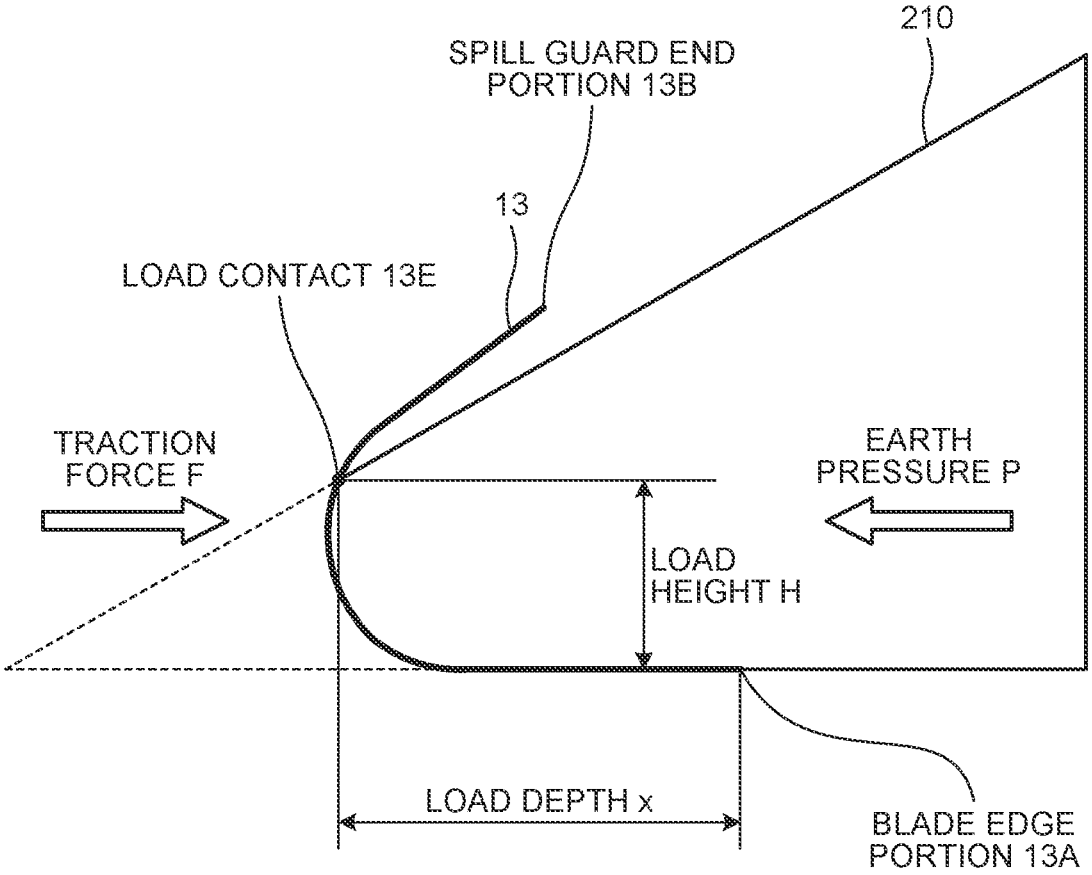
FIG. 12 is a diagram illustrating a relationship between traction force and earth pressure according to the embodiment.

FIG. 12 is a diagram illustrating a relationship between the traction force F and earth pressure P according to the embodiment. The amount that the bucket 13 is inserted into the natural ground 210 is determined based on the traction force F. In addition, the bucket 13 receives the earth pressure P representing excavation resistance from the natural ground 210. In a case where the height of the object to be excavated with the blade edge portion 13A as the base point inside the bucket 13 during the excavation work is defined as a load height H, a relationship of the following formula (5) called Coulomb's earth pressure theory is established between the earth pressure P and the load height H. In the formula (5), K represents an earth pressure coefficient.

$$P = \frac{1}{2}\rho H^2 K \quad K\text{: EARTH PRESSURE COEFFICIENT} \quad (5)$$

A state where the wheel loader 1 cannot move forward and stops when the bucket 13 is inserted into the natural ground 210 is a state where the traction force F and the earth pressure P are balanced. In a case where the traction force F and the earth pressure P are balanced, the following formula (6) is established.

$$F = \frac{1}{2}\rho H^2 K \quad (6)$$

The weight calculation unit 81 calculates the load height H based on the traction force F. As shown in the following formula (7), the load height H is calculated based on the traction force F, the density ρ, and the earth pressure coefficient K.

$$H = \sqrt{\frac{2F}{\rho K}} \quad (7)$$

The traction force F is calculated by the traction force calculation unit 73. The density ρ and the earth pressure coefficient K are stored in the characteristic storage unit 61. Therefore, the weight calculation unit 81 can calculate the load height H based on the traction force F, the density ρ, and the earth pressure coefficient K.

In the following description, a boundary between the inner surface of the bucket 13 and an upper end of the excavated object 300 is defined as a load contact 13E, and a distance between the load contact 13E and the blade edge portion 13A in the horizontal direction (front-rear direction) is defined as a load depth x. The load depth x can be calculated based on the load height H, the bucket angle θbk, and the bucket data.

The weight calculation unit 81 calculates the weight Wa of the excavated object 300 based on the load height H calculated based on the traction force F and the earth pressure coefficient K, the bucket angle θbk, and the bucket data.

Figure 13:
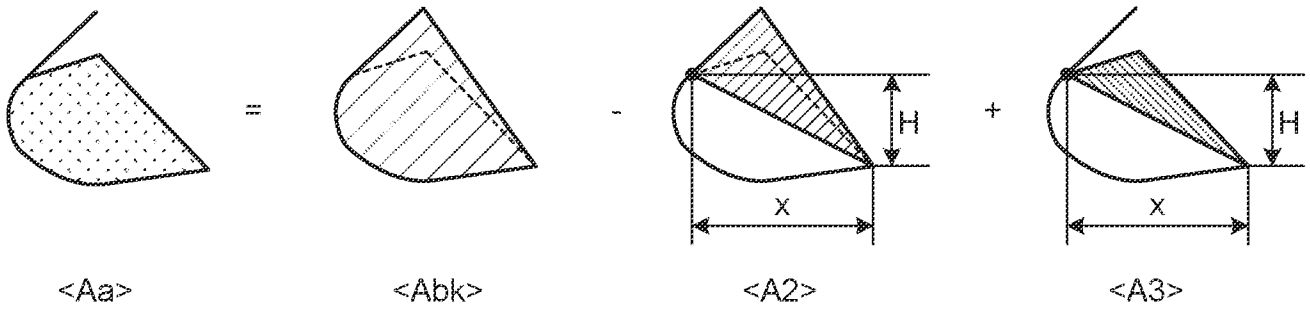
FIG. 13 is a schematic diagram for explanation of a method of calculating the weight of an excavated object based on a second calculation method according to the embodiment.

FIG. 13 is a schematic diagram for explanation of a method of calculating the weight Wa of the excavated object 300 based on the second calculation method according to the embodiment.

As illustrated in FIG. 13, a void cross-sectional area A2 and a load shape portion cross-sectional area A3 are defined. In a case where a void space is set as a space between a first plane connecting the load contact 13E and the blade edge portion 13A and orthogonal to the YZ plane and a second plane defined by the opening portion 136, the void cross-sectional area A2 represents a cross-sectional area of the void space orthogonal to the pivot AXb. In a case where the excavated object 300 present between the first plane and the second plane is set as a load shape space, the load shape portion cross-sectional area A3 represents a cross-sectional area of the load shape space orthogonal to the pivot AXb.

The void cross-sectional area A2 is calculated based on the following formula (8). As shown in the formula (8), the weight calculation unit 81 calculates the void cross-sectional area A2 based on the load height H, the bucket angle θbk, and the bucket data.

$$A2 = \text{abs}\left(\frac{L^2 \times \sin(\theta sp + \theta 3) \times \sin\left(a\tan\left(\frac{H}{x}\right) - \theta 3 + \theta bk\right)}{2 \times \sin\left(\theta sp + \theta bk + a\tan\left(\frac{H}{x}\right)\right)}\right) \quad (8)$$

The load shape portion cross-sectional area A3 is calculated based on the following formula (9). As shown in the formula (9), the weight calculation unit 81 calculates the load shape portion cross-sectional area A3 based on the load height H, the near-side load angle θ1, and the blade edge side load angle θ2.

$$A3 = \frac{(H^2 + x^2) \times \sin\left(\theta 1 + a\tan\left(\frac{H}{x}\right)\right) \times \sin\left(\theta 2 - a\tan\left(\frac{H}{x}\right)\right)}{2 \times \sin(\theta 1 + \theta 2)} \quad (9)$$

The load cross-sectional area Aa is calculated based on the following formula (10).

$$Aa = Abk - A2 + A3 \quad (10)$$

The load cross-sectional area Aa is calculated, so that the weight calculation unit 81 can calculate the weight Wa based on the formulas (3) and (4).

<Near-Side Load Angle Determination Unit>

The near-side load angle determination unit 82 determines the near-side load angle θ1 to be a predetermined angle. The predetermined angle includes at least one of the natural ground angle θg, a sum of the natural ground angle θg and a bucket angle increase amount Δθbk, and the angle of repose θr.

Figure 14:
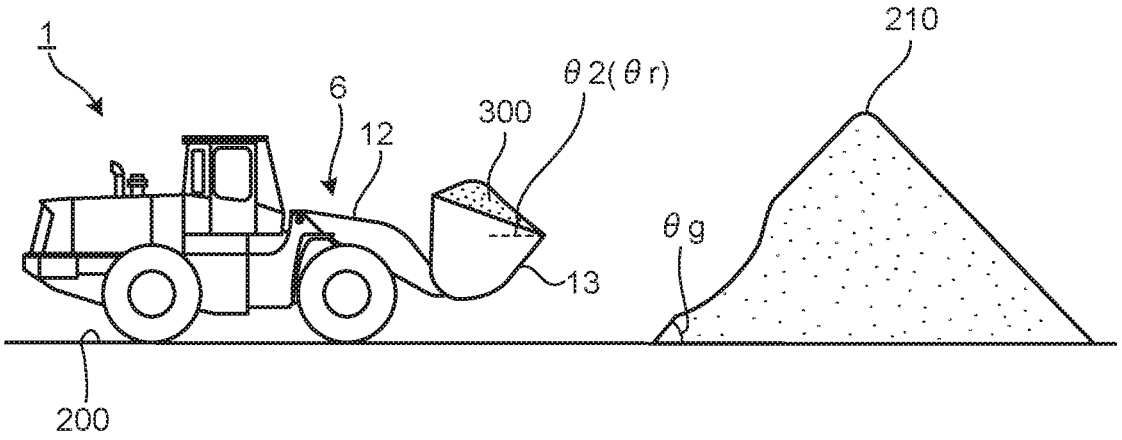
FIG. 14 is a diagram for explanation of an angle of repose and a natural ground angle according to the embodiment.

FIG. 14 is a diagram for explanation of the angle of repose θr and the natural ground angle θg according to the embodiment.

The angle of repose θr is an angle of the slope of the earth and sand with respect to the horizontal plane for a case where the shape of the earth and sand is kept stable without collapsing when the earth and sand are piled up. The angle of repose θr is a physical property value uniquely determined based on the property of the earth and sand. When the bucket 13 inserted into the natural ground 210 is removed from the natural ground 210, the blade edge side load angle θ2 is equal to the angle of repose θr.

The natural ground angle θg is an angle formed by the ground 200 and the surface of the natural ground 210 constituted by earth and sand placed on the ground 200. Although the natural ground angle θg is substantially equal to the angle of repose θr, the natural ground angle θg sometimes changes based on the conditions for forming the natural ground 210. The conditions for forming the natural ground 210 include a drop height and the volume of earth and sand when the earth and sand are dropped on the ground 200 to form the natural ground 210.

That is, the angle of repose θr is the angle of inclination of the surface of the earth and sand formed by gently dropping the earth and sand on the horizontal plane, whereas the natural ground angle θg is the angle of inclination of the surface of the natural ground 210 that may change based on the impact received by the earth and sand or the volume of the natural ground 210 when the earth and sand are dropped on the horizontal plane.

Figure 15:
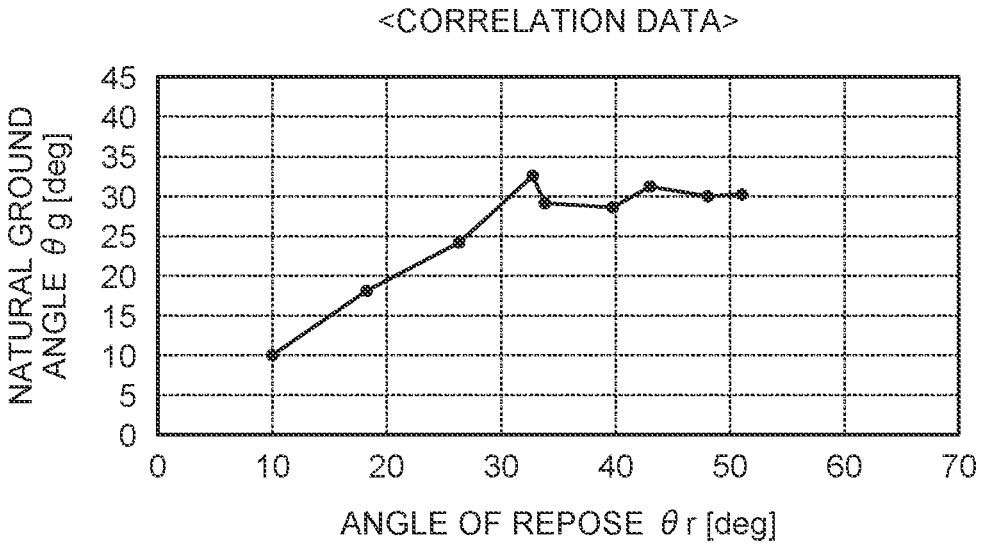
FIG. 15 is a diagram illustrating a relationship between a natural ground angle and an angle of repose according to the embodiment.

FIG. 15 is a diagram illustrating a relationship between the natural ground angle θg and the angle of repose θr according to the embodiment. In FIG. 15, the horizontal axis represents the angle of repose θr, and the vertical axis represents the natural ground angle θg. For example, in the case of earth and sand having a small angle of repose θr, the angle of repose θr of the earth and sand is substantially equal to the natural ground angle θg of the natural ground 210 formed by the earth and sand. On the other hand, in the case of earth and sand having a large angle of repose θr, there is a high possibility that the natural ground angle θg of the natural ground 210 formed by the earth and sand becomes smaller than the angle of repose θr of the earth and sand.

The correlation data indicating the relationship between the natural ground angle θg and the angle of repose θr as illustrated in FIG. 15 is stored in the characteristic storage unit 61. The near-side load angle determination unit 82 can calculate the natural ground angle θg based on, for example, the angle of repose θr and the correlation data.

Note that the natural ground angle θg may be actually measured and stored in the characteristic storage unit 61.

<Repose Angle Calculation Unit>

The repose angle calculation unit 91 calculates the angle of repose θr of the earth and sand based on the excavated object 300 held by the bucket 13. The angle of repose θr calculated by the repose angle calculation unit 91 is stored in the characteristic storage unit 61.

The angle of repose θr is a physical property value of earth and sand determined based on the property of the earth and sand. For example, when the property of the earth and sand changes due to weather or the like, the angle of repose θr may change. For example, the angle of repose θr may be different between good weather and rainy weather. The repose angle calculation unit 91 calculates the angle of repose θr and stores the same in the characteristic storage unit 61.

The repose angle calculation unit 91 calculates the angle of repose θr based on the bucket data stored in the bucket data storage unit 62, the bucket angle θbk calculated by the bucket angle calculation unit 72, the weight Wa of the excavated object 300 detected by the weight sensor 34, and the density ρ of the excavated object 300 stored in the characteristic storage unit 61.

Figure 16:
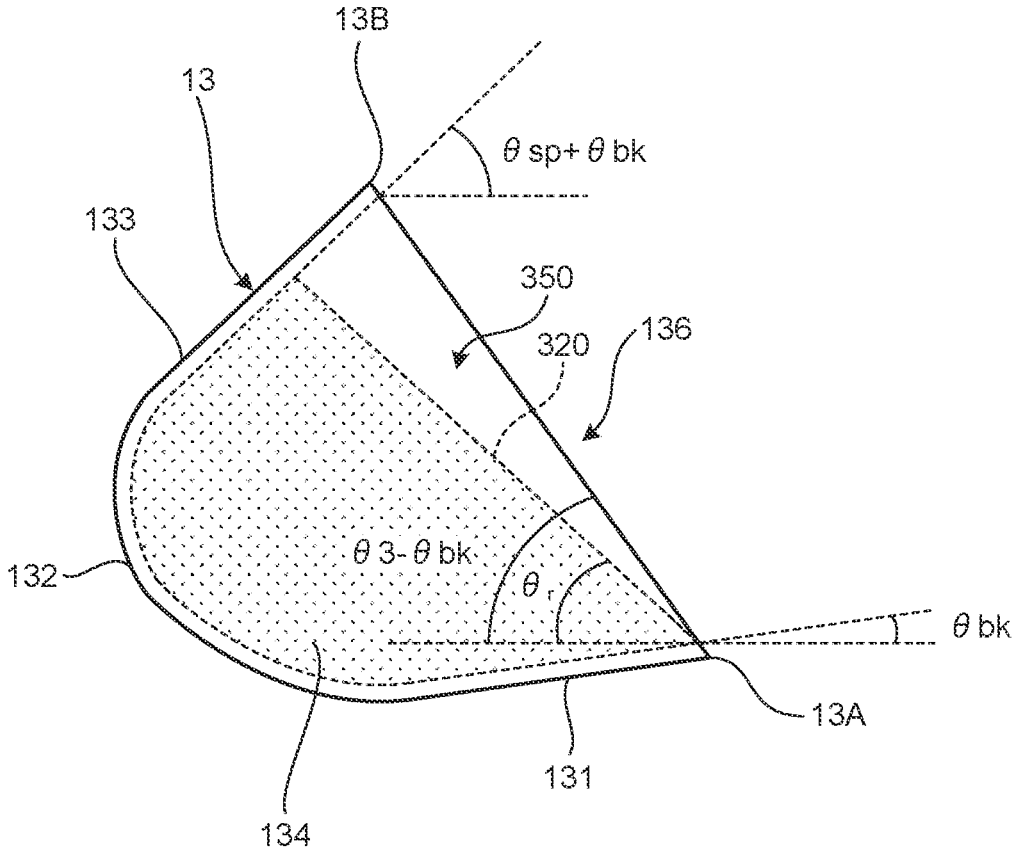
FIG. 16 is a diagram for explanation of an angle of repose of an excavated object held by the bucket according to the embodiment.

FIG. 16 is a diagram for explanation of the angle of repose θr of the excavated object 300 held by the bucket 13 according to the embodiment. As illustrated in FIG. 16, when the bucket 13 is dumped to incline the opening portion 136 of the bucket 13 forward from a state where the bucket 13 is filled with the excavated object 300, a part of the excavated object 300 is discharged from the bucket 13 due to the action of gravity. When a part of the excavated object 300 is discharged from the bucket 13, as illustrated in FIG. 16, a slope with the blade edge portion 13A as the base point is formed on the surface of the excavated object 300. The angle of repose θr is an angle, with respect to the horizontal plane, of a slope in which the surface of the excavated object 300 stays without sliding down with the blade edge portion 13A as the base point. The angle of repose θr is an angle, with respect to the horizontal plane, of a slope that is exposed to the opening portion 136 of the bucket 13 and formed by the surface of the excavated object 300 with the blade edge portion 13A as the base point.

A method of calculating the angle of repose θr will be described in detail. After the bucket 13 is filled with the excavated object 300, a part of the excavated object 300 held by the bucket 13 is discharged as illustrated in FIG. 16. A part of the excavated object 300 held by the bucket 13 is discharged, which results in the state where the slope of the surface of the excavated object 300 stays without sliding down is maintained, in other words, the state where the slope of the surface of the excavated object 300 held by the bucket 13 on the YZ plane is maintained at the angle of repose θr. An unfilled part cross-sectional area A4 of an unfilled part 350 of the bucket 13 in this state is calculated based on the following formula (11) using the bucket length L stored in the bucket data storage unit 62, the blade edge side opening angle θ3, and the upper opening angle θsp for a case where the bucket 13 is horizontal (hereinafter, it is referred to as "when the bucket is horizontal").

$$A4 = \text{abs}\left(\frac{L^2 \times \sin(\theta sp + \theta 3) \times \sin(\theta_r - \theta 3 + \theta bk)}{2 \times \sin(\theta sp + \theta bk + \theta_r)}\right) \tag{11}$$

The load cross-sectional area Aa in this state is calculated based on the following formula (12) using the bucket cross-sectional area Abk stored in the bucket data storage unit 62 and the unfilled part cross-sectional area A4 of the unfilled part 350 of the bucket 13.

$$Aa = Abk - A4 \tag{12}$$

The volume Va of the excavated object 300 is calculated based on the formula (3), and the weight Wa of the excavated object 300 is calculated based on the formula (4).

In addition, the following formula (13) is established based on the formulas (11), (3), (4), and (12). The repose angle calculation unit 91 calculates the angle of repose θr based on the formula (13).

$$\left(Abk - \text{abs}\left(\frac{L^2 \times \sin(\theta sp + \theta 3) \times \sin(\theta_r - \theta 3 + \theta bk)}{2 \times \sin(\theta sp + \theta bk + \theta_r)}\right)\right) \times B \times \rho = Wa \tag{13}$$

<Earth Pressure Coefficient Calculation Unit>

The earth pressure coefficient calculation unit 92 calculates the earth pressure coefficient K of the natural ground 210. As shown in the formula (5), the earth pressure coefficient K is used to calculate the earth pressure P. The earth pressure coefficient calculation unit 92 calculates the earth pressure coefficient K of the natural ground 210 based on the excavated object 300 held by the bucket 13. The earth pressure coefficient calculation unit 92 calculates the earth pressure coefficient K of the natural ground 210 based on the traction force F and the load height H. The earth pressure coefficient K calculated by the earth pressure coefficient calculation unit 92 is stored in the characteristic storage unit 61.

The earth pressure coefficient K is a physical property value of the natural ground 210 based on the property of the natural ground 210. For example, when the property of the natural ground 210 changes due to weather or the like, the earth pressure coefficient K may change. The earth pressure coefficient calculation unit 92 calculates the earth pressure coefficient K and stores the same in the characteristic storage unit 61.

The detection data acquisition unit 71 acquires the bucket angle θbk during the excavation work. The earth pressure coefficient calculation unit 92 acquires, from the weight sensor 34, the weight W of the excavated object 300 held by the bucket 13 after the excavation work. The earth pressure coefficient calculation unit 92 calculates the load height H based on the bucket angle θbk acquired by the detection data acquisition unit 71, the density ρ of the natural ground 210 stored in the characteristic storage unit 61, and the bucket data stored in the bucket data storage unit 62.

As illustrated in FIG. 11, for example, in a case where the void 340 is present in the bucket 13, the surface of the excavated object 300 includes a first surface 310 sloping upwardly toward the front and a second surface 320 that is connected to a front end of the first surface 310 and slopes downwardly toward the front, the load cross-sectional area Aa of the excavated object 300 is calculated based on the formula (10), and the relationship of the following formula (14) is established.

$$\frac{W}{\rho \times B} = Abk - \text{abs}\left(\frac{L^2 \times \sin(\theta sp + \theta 3) \times \sin\left(a\tan\left(\frac{H}{x}\right) - \theta 3 + \theta bk\right)}{2 \times \sin\left(\theta sp + \theta bk + a\tan\left(\frac{H}{x}\right)\right)}\right) + \frac{(H^2 + x^2) \times \sin\left(\theta 1 + a\tan\left(\frac{H}{x}\right)\right) \times \sin\left(\theta 2 - a\tan\left(\frac{H}{x}\right)\right)}{2 \times \sin(\theta 1 + \theta 2)} \tag{14}$$

In the formula (14), the only unknowns are the load height H and the load depth x. As described above, since the load depth x can be calculated based on the load height H, the bucket angle θbk, and the bucket data, the unknown in the formula (14) is only the load height H substantially. In a case where the bucket angle θbk is not changed during excavation, the near-side load angle θ1 is substantially equal to the natural ground angle θg, and the blade edge side load angle θ2 is substantially equal to the angle of repose θr. Thus, as shown in the formula (14), the earth pressure coefficient calculation unit 92 can calculate the load height H based on the near-side load angle θ1, the blade edge side load angle θ2, the bucket angle θbk, and the bucket data.

The earth pressure coefficient K is expressed by the following formula (15) based on the traction force F at the time of excavating the excavated object 300 and the load height H calculated from the formula (14). As shown in the formula (15), the earth pressure coefficient calculation unit 92 can calculate the earth pressure coefficient K based on the traction force F, the load height H, and the density ρ.

$$K = \frac{2F}{\rho H^2} \tag{15}$$

<Working Equipment Control Unit>

The working equipment control unit 100 controls the posture of the working equipment 6 so that the weight Wa calculated by the weight calculation unit 81 becomes a target weight Wr. The posture of the working equipment 6 includes the bucket angle θbk representing the angle of the bucket 13 with respect to the horizontal plane. When the bucket angle θbk changes, the near-side load angle θ1 changes. During the excavation work, the working equipment control unit 100 controls at least one of the lift cylinder 18 and the bucket cylinder 19 to adjust the bucket angle θbk. The bucket angle θbk is adjusted, so that the near-side load angle θ1 is adjusted. The near-side load angle θ1 is adjusted, so that the weight Wa of the excavated object 300 is adjusted. The working equipment control unit 100 controls the bucket angle θbk representing the posture of the bucket 13 so that the weight Wa calculated by the weight calculation unit 81 becomes the target weight Wr.

The working equipment control unit 100 removes the bucket 13 from the natural ground 210 while maintaining the near-side load angle θ1 and the bucket angle θbk for a case where the weight Wa reaches the target weight Wr. As a result, the difference between the weight Wa of the excavated object 300 held by the bucket 13 and the target weight Wr is reduced.

[Method for Calculating Angle of Repose]

Figure 17:
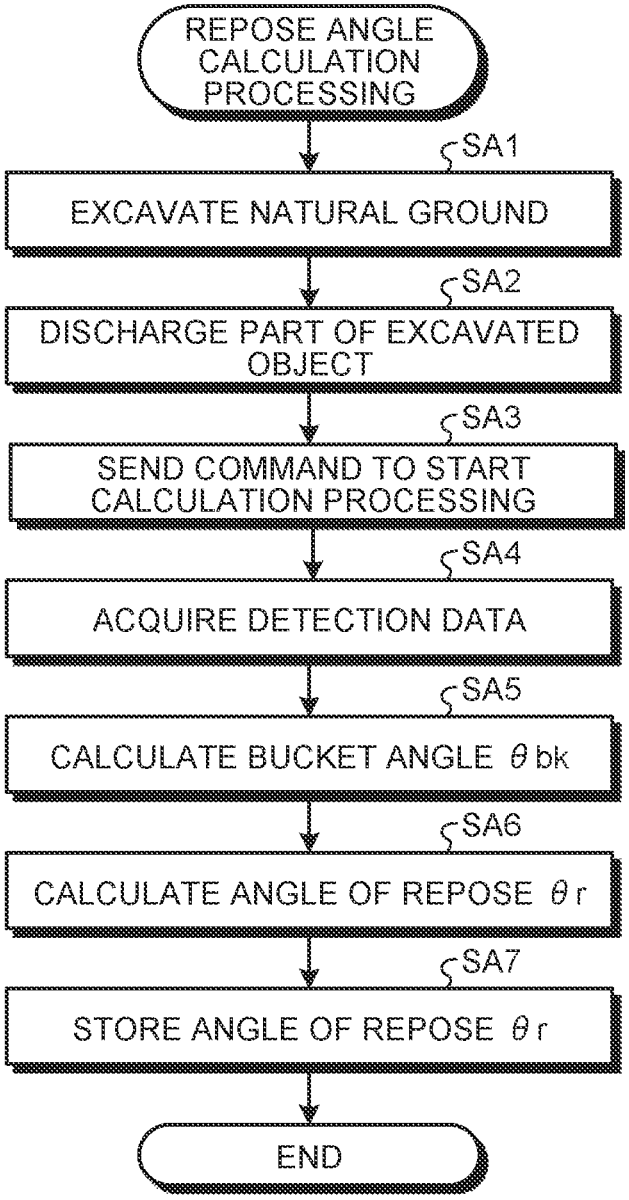
FIG. 17 is a flowchart illustrating a method of calculating an angle of repose according to the embodiment.

FIG. 17 is a flowchart illustrating a method of calculating the angle of repose θr according to the embodiment. Before work of excavating the natural ground 210 for the first time, an operator causes the controller 50 to start processing of calculating the angle of repose θr.

The operator excavates the natural ground 210 with the bucket 13 and holds the excavated object 300 (Step SA1). More specifically, for example, as illustrated in FIG. 9, after excavating the natural ground 210 such that the inside of the bucket 13 is filled with the excavated object 300, the operator causes the bucket 13 to perform tilting operation so that the excavated object 300 is held in the bucket 13.

Next, the operator discharges a part of the excavated object 300 from the bucket 13 (Step SA2). More specifically, the operator causes the bucket 13 to perform dumping operation to such an extent that the excavated object 300 is not completely discharged from the bucket 13, from a state where the bucket 13 is filled with the excavated object 300. For example, the operator causes the bucket 13 to perform the dumping operation between the position for tilting operation in Step SA1 and an angle at which the bucket angle θbk is larger than 0 degrees. When a part of the excavated object 300 is discharged from the bucket 13, as illustrated in FIG. 16, the surface of the excavated object 300 held by the bucket 13 maintains a slope of the surface stays at a predetermined position without sliding down with the blade edge portion 13A as the base point. The angle of the surface of the excavated object 300 of the bucket 13 is maintained at the angle of repose θr.

Next, in the state of Step SA2, the operator transmits a command to start the processing of calculating the angle of repose θr to the controller 50 (Step SA3). More specifically, in response to the operator operating the operator command device 23, the operator command device 23 outputs, to the controller 50, an operation command signal to start the processing of calculating the angle of repose θr.

The detection data acquisition unit 71 acquires the vehicle body inclination angle θa, the boom angle θb, the bell crank angle θc, and the weight Wa of the excavated object 300 in a state where the surface of the excavated object 300 held by the bucket 13 on the YZ plane is maintained at the angle of repose θr (Step SA4).

The bucket angle calculation unit 72 calculates the bucket angle θbk based on the vehicle body inclination angle θa, the boom angle θb, and the bell crank angle θc acquired by the detection data acquisition unit 71 (Step SA5).

The repose angle calculation unit 91 calculates the angle of repose θr based on the detection data on the angle of the vehicle body 2, the bucket data stored in the bucket data storage unit 62, the weight Wa of the excavated object 300 acquired in Step SA4, and the bucket angle θbk calculated in Step SA5 (Step SA6).

The characteristic storage unit 61 stores the angle of repose θr calculated by the repose angle calculation unit 91 (Step SA7).

[Method for Calculating Earth Pressure Coefficient]

Figure 18:
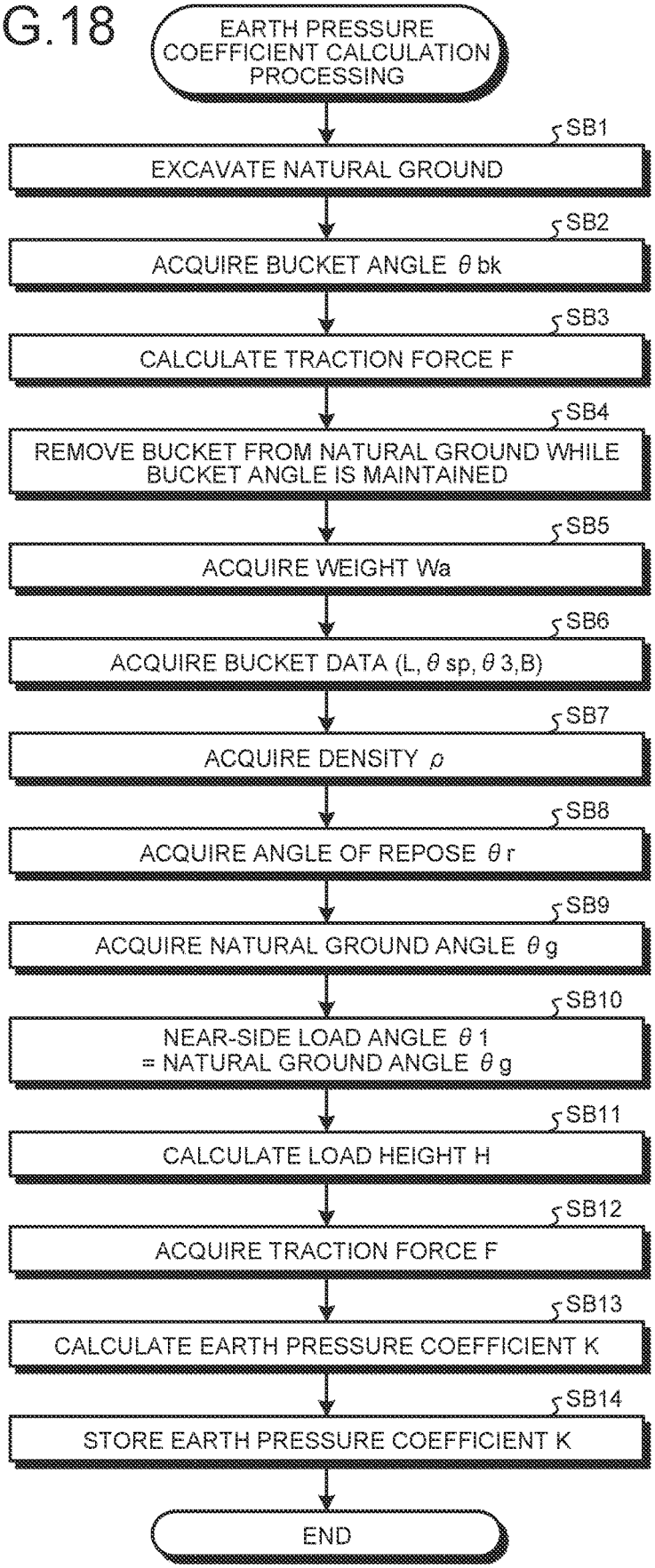
FIG. 18 is a flowchart illustrating a method of calculating an earth pressure coefficient according to the embodiment.

FIG. 18 is a flowchart illustrating a method of calculating the earth pressure coefficient K according to the embodiment. Before work of excavating the natural ground 210 for the first time, an operator causes the controller 50 to start processing of calculating the angle of repose θr.

The operator excavates the natural ground 210 with the bucket 13 so as not to change the bucket angle θbk (Step SB1).

The bucket angle calculation unit 72 acquires the bucket angle θbk during the excavation work. The earth pressure coefficient calculation unit 92 acquires the bucket angle θbk calculated by the bucket angle calculation unit 72 (Step SB2).

The traction force calculation unit 73 calculates the traction force F during the excavation work (Step SB3).

Next, the operator removes the bucket 13 from the natural ground 210 while the bucket angle θbk is maintained. The operator also operates the operator command device 23 to output, to the controller 50, an operation command signal to start the processing of calculating the earth pressure coefficient K (Step SB4).

Detection data of the weight sensor 34 is acquired by the detection data acquisition unit 71. The earth pressure coefficient calculation unit 92 acquires the weight Wa of the excavated object 300 held by the bucket 13 and detected by the weight sensor 34 (Step SB5).

The earth pressure coefficient calculation unit 92 acquires, as the bucket data, the bucket length L, the upper opening angle θsp, the blade edge side opening angle θ3, and the bucket width B from the bucket data storage unit 62 (Step SB6).

The earth pressure coefficient calculation unit 92 acquires the density ρ of the natural ground 210 from the characteristic storage unit 61 (Step SB7).

The earth pressure coefficient calculation unit 92 acquires the angle of repose θr from the characteristic storage unit 61 (Step SB8).

The earth pressure coefficient calculation unit 92 acquires the natural ground angle θg from the characteristic storage unit 61 (Step SB9).

The earth pressure coefficient calculation unit 92 determines, as the near-side load angle θ1, the natural ground angle θg, and determines, as the blade edge side load angle θ2, the angle of repose θr (Step SB10).

The earth pressure coefficient calculation unit 92 calculates the load height H based on the formula (14) (Step SB11).

The earth pressure coefficient calculation unit 92 acquires the traction force F calculated in Step SB3 from the traction force calculation unit 73 (Step SB12).

The earth pressure coefficient calculation unit 92 calculates the earth pressure coefficient K based on the formula (15) (Step SB13).

The characteristic storage unit 61 stores the earth pressure coefficient K calculated by the earth pressure coefficient calculation unit 92 in Step SB13 (Step SB14).

As described above, in the embodiment, the earth pressure coefficient calculation unit 92 calculates the earth pressure coefficient K of the natural ground 210. As a result, even if the property of the natural ground 210 changes due to, for example, weather or the like, the correct earth pressure coefficient K is calculated.

OTHER EMBODIMENTS

In the embodiment described above, the angle of repose θr is calculated based on the excavated object 300 held by the bucket 13. The angle of repose θr may be calculated based on the excavated object 300 not held by the bucket 13. For example, the angle of repose θr may be calculated in an experimental facility or an evaluation facility. In addition, in a case where the angle of repose θr is known, the processing of calculating the angle of repose θr may be omitted. It is only required that, before the excavation work, the angle of repose θr is stored in the characteristic storage unit 61.

In the embodiment described above, the loading machine 1 is described as being operated by an operator, but the present invention is not limited thereto. The loading machine 1 may be operated by a remote system. In this case, for example, a device having the function of the controller 50 and a remote operation device is provided at the remote control location.

In the embodiment described above, the loading machine 1 is a wheel loader. The loading machine 1 may be an excavator having front-loading working equipment. The loading machine 1 may be an excavator having backhoe working equipment in which an opening portion of a bucket faces backward during the excavation work.

The invention claimed is:

1. A control system for controlling a loading machine including working equipment having a bucket, the control system comprising:

a controller, the controller being configured to calculate a traction force of the loading machine during excavation work of excavating an object to be excavated with the bucket while the loading machine moves forward, calculate a load height representing a height of the object to be excavated inside the bucket during the excavation work, and calculate an earth pressure coefficient of the object to be excavated based on the traction force and the load height.

2. The control system according to claim 1, wherein the controller is further configured to acquire a bucket angle representing an angle of the bucket with respect to a horizontal plane during the excavation work, acquire a weight of an excavated object, which is the object to be excavated, held by the bucket, and calculate the load height based on the bucket angle, the weight of the excavated object, a density of the object to be excavated, and bucket data indicating a shape and a dimension of the bucket.

3. The control system according to claim 2, wherein the loading machine excavates the object to be excavated with the bucket, a surface of the excavated object excavated by the bucket includes a first surface that slopes upwardly toward a front, and a second surface that is connected to a front end of the first surface and slopes downwardly toward the front, and the controller is further configured to calculate the load height based on a near-side load angle representing an angle of the first surface with respect to a horizontal plane and a blade edge side load angle representing an angle of the second surface with respect to the horizontal plane.

4. The control system according to claim 3, wherein the object to be excavated is natural ground constituted by earth and sand placed on ground, and the controller is further configured to store a natural ground angle representing an angle formed by the ground and a surface of the natural ground, the near-side load angle including the natural ground angle.

5. The control system according to claim 4, wherein the controller is further configured to store an angle of repose of the earth and sand, and the blade edge side load angle including the angle of repose.

6. A loading machine comprising:

the control system according to claim 1.

7. A control method for controlling a loading machine including working equipment having a bucket, the control method comprising:

calculating a traction force of the loading machine during excavation work of excavating an object to be excavated with the bucket while the loading machine moves forward;

acquiring a bucket angle representing an angle of the bucket with respect to a horizontal plane during the excavation work;

acquiring a weight of an excavated object, which is the object to be excavated, held by the bucket;

calculating a load height representing a height of the object to be excavated inside the bucket during the excavation work based on the bucket angle, the weight of the excavated object, a density of the object to be excavated, and bucket data indicating a shape and a dimension of the bucket; and calculating an earth pressure coefficient of the object to be excavated based on the traction force and the load height.

8. A control system for controlling a loading machine including working equipment having a bucket, the control system comprising:

a controller, the controller being configured to calculate traction force of the loading machine during excavation work of excavating an object to be excavated with the bucket while the loading machine moves forward, acquire a bucket angle representing an angle of the bucket with respect to a horizontal plane during the excavation work, acquire a weight of an excavated object, which is the object to be excavated, held by the bucket, calculate a load height representing a height of the object to be excavated inside the bucket during the excavation work based on the bucket angle and the weight of the excavated object, and calculate an earth pressure coefficient of the object to be excavated based on the traction force and the load height.

* * * * *